US011210980B2

(12) United States Patent
Gao et al.

(10) Patent No.: US 11,210,980 B2
(45) Date of Patent: Dec. 28, 2021

(54) DETECTION METHOD FOR DISPLAY PANEL, DISPLAY PANEL AND DISPLAY DEVICE

(71) Applicant: Shanghai Tianma AM-OLED Co., Ltd., Shanghai (CN)

(72) Inventors: Yana Gao, Shanghai (CN); Xingyao Zhou, Shanghai (CN); Mengmeng Zhang, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 17/228,942

(22) Filed: Apr. 13, 2021

(65) Prior Publication Data

US 2021/0233445 A1 Jul. 29, 2021

(30) Foreign Application Priority Data

Dec. 30, 2020 (CN) ..... 202011606283.6

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01); *G09G 2310/0286* (2013.01); *G09G 2310/08* (2013.01)

(58) Field of Classification Search
CPC ..... G09G 3/006; G09G 3/3225; G09G 2310/0286; G09G 2310/08; G09G 3/20
See application file for complete search history.

(56) References Cited

U.S. PATENT DOCUMENTS

2015/0243214 A1* 8/2015 Jeong ..... G09G 3/006 345/214
2016/0140896 A1* 5/2016 Kwon ..... G09G 3/3225 345/76
2019/0392743 A1* 12/2019 Lee ..... G09G 5/10

FOREIGN PATENT DOCUMENTS

GN 109859672 A 6/2019
GN 110097841 A 8/2019
GN 110232888 A 9/2019

* cited by examiner

*Primary Examiner* — Muhammad N Edun
(74) *Attorney, Agent, or Firm* — Tarolli, Sundheim, Covell & Tummino LLP

(57) ABSTRACT

A detection method for a display panel, a display panel and a display device are provided. The display panel has a display area and a non-display area, and one data line in the display area is electrically connected to at least one sub-pixel; and the non-display area includes at least one signal line electrically connected to at least one data line through a switch unit. The method includes: providing a pulse signal to the signal line; controlling the switch unit to be turned on once in a period of at least one signal hopping on the signal line, to write a data signal into the data line through the signal line, where the data signal is the pulse signal truncated in the period of the signal hopping of the pulse signal; and controlling the sub-pixel connected to the data line to emit light.

22 Claims, 19 Drawing Sheets

DETECTION METHOD FOR DISPLAY PANEL, DISPLAY PANEL AND DISPLAY DEVICE

CROSS-REFERENCE TO RELATED APPLICATIONS

The present disclosure claims priority to Chinese Patent Application No. 202011606283.6, filed on Dec. 30, 2020, the content of which is incorporated herein by reference in its entirety.

TECHNICAL FIELD

The present disclosure relates to the field of display technology, and in particular, to a detection method for a display panel, a display panel and a display device.

BACKGROUND

In a current process for manufacturing a display panel, a crack may be caused on a signal line in the display panel. Some existing methods can be used to detect the crack on the signal line. However, the conventional process for manufacturing the display panel may cause a micro-crack on the signal line. The micro-crack has little influence on the resistance of the signal line and will not affect a signal transmission function of the signal line, so the display panel can display normally. Thus, the micro-crack will not be easily detected. In earlier usage of the display panel, the micro-crack on the signal line does not have an effect on display. However, after a long period of usage, the micro-crack gradually increases as the signal line ages, resulting in breakage of the signal line, which will cause the panel display to fail. Therefore, a method for detecting a micro-crack on a signal line in this field is needed.

SUMMARY

A detection method for a display panel, a display panel, and a display device are provided according to embodiments of the present disclosure, aiming to detect a micro-crack on the signal line.

In a first aspect, a detection method for a display panel is provided according to an embodiment of the present disclosure. The display panel has a display area and a non-display area. The display panel includes a plurality of data lines arranged in the display area, where one of the plurality of data lines is connected to at least one sub-pixel arranged in one pixel column; at least one signal line, at least one switch unit, and at least one switch control line that are arranged in the non-display area, where one signal line of the at least one signal line is electrically connected to at least one data line through one switch unit of the at least one switch unit, the switch unit includes: a control terminal electrically connected to one of the at least one switch control line, an input terminal electrically connected to the signal line, and an output terminal electrically connected to the at least one data line; and the detection method includes: providing a pulse signal to the signal line; controlling the switch unit to be turned on once in a period of at least one signal hopping of the pulse signal on the signal line, to electrically connect the signal line with the at least one data line, and writing a data signal to the at least one data line through the signal line, where the data signal is the pulse signal truncated in the period of signal hopping of the pulse signal; and controlling, based on the data signal, at least one sub-pixel connected to the at least one data line to emit light; and determining that the signal line has a micro-crack when a brightness of the at least one sub-pixel connected to the at least one data line corresponding to the signal line is different from a reference brightness.

In a second aspect, a display panel is provided according to an embodiment of the present disclosure. The display panel has a display area and a non-display area. The display panel includes: a plurality of data lines arranged in the display area, where one of the plurality of data lines is electrically connected to at least one sub-pixel in one pixel column; at least one signal line, at least one switch unit, and at least one switch control line that are arranged in the non-display area, where one signal line of the at least one signal line is electrically connected to at least one data line through one switch unit of the at least one switch unit. The switch unit includes: a control terminal electrically connected to one of the at least one switch control line, an input terminal electrically connected to the signal line, and an output terminal electrically connected to at least one data line; and the detection method according to the above description is applicable to the display panel to detect a micro-crack on the signal line.

In a third aspect, a display device is provided according to an embodiment of the present disclosure. The display device includes the display panel provided by any embodiment of the present disclosure.

BRIEF DESCRIPTION OF DRAWINGS

In order to more clearly illustrate technical solutions in embodiments of the present disclosure or in the related art, the accompanying drawings are briefly introduced as follows. It should be noted that the drawings described as follows are merely part of the embodiments of the present disclosure, and other drawings can also be acquired by those skilled in the art without paying creative efforts.

DESCRIPTION OF EMBODIMENTS

In order to make the purpose, technical solutions, and advantages of the embodiments of the present disclosure be understandable, the technical solutions in the embodiments of the present disclosure are described in the following with reference to the accompanying drawings. It should be understood that the described embodiments are merely exemplary embodiments of the present disclosure, which shall not be interpreted as providing limitations to the present disclosure. All other embodiments obtained by those skilled in the art without creative efforts according to the embodiments of the present disclosure are within the scope of the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

A detection method for a display panel is provided according to an embodiment of the present disclosure. According to a phenomenon that a micro-crack on the signal line will cause a delay of the signal transmitted therein, the signal on the signal line is truncated in a period of signal hopping, to use as a data signal to control the sub-pixel to emit light. When the signal line has a micro-crack, the data signal written into the sub-pixel is different from the reference data signal, and the brightness of the corresponding sub-pixel is different from the reference brightness, so as to determine that the signal line has a micro-crack. In this way, the micro-crack on the signal line can be detected. Therefore, the product with a micro-crack on the signal line can be detected before the display panel is shipped from the factory, thereby improving the performance and reliability of the product shipped from the factory.

The detection method provided by an embodiment of the present disclosure will be described in detail in the following in combination with a structure of a display panel.

Figure 1:
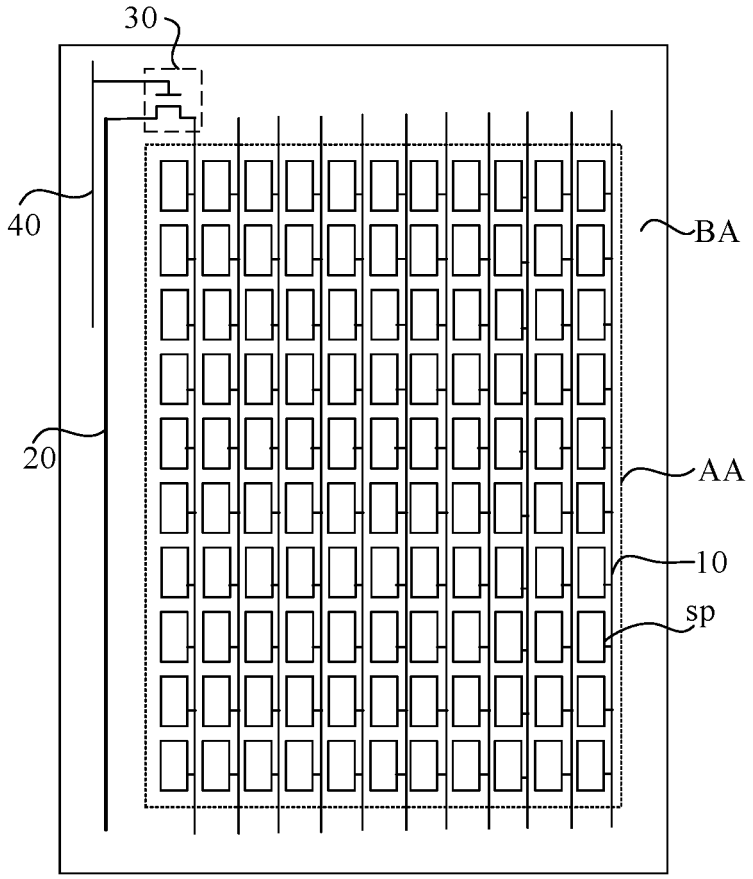
FIG. 1 is a schematic diagram of a display panel according to an embodiment of the present disclosure.
Figure 2:
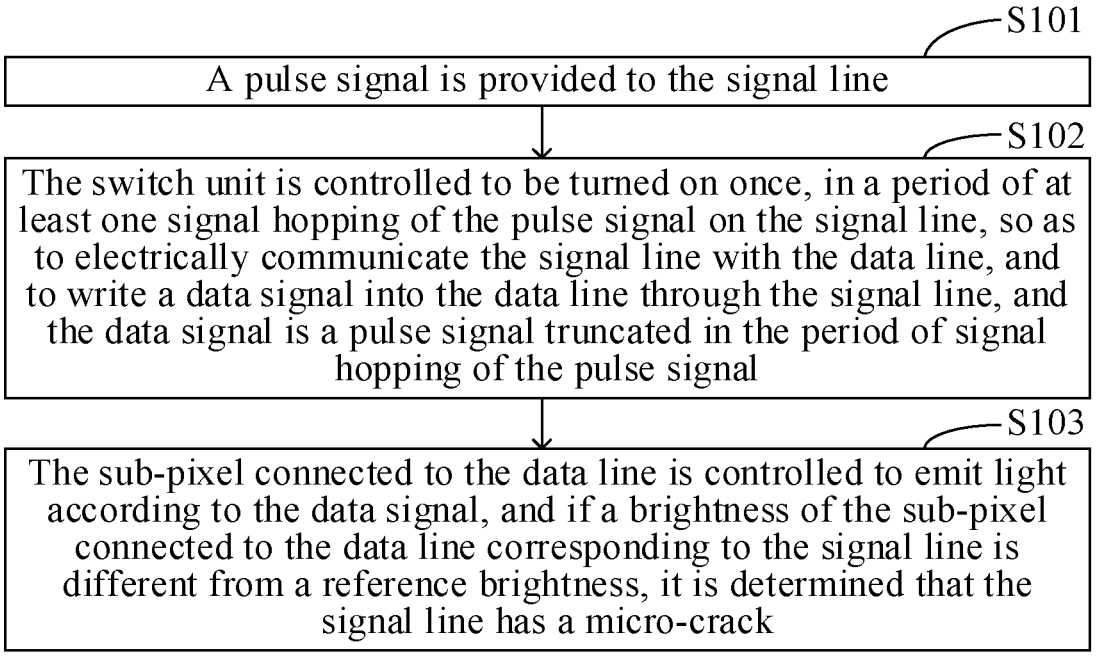
FIG. 2 is a flowchart of a detection method for a display panel according to an embodiment of the present disclosure.
Figure 3:
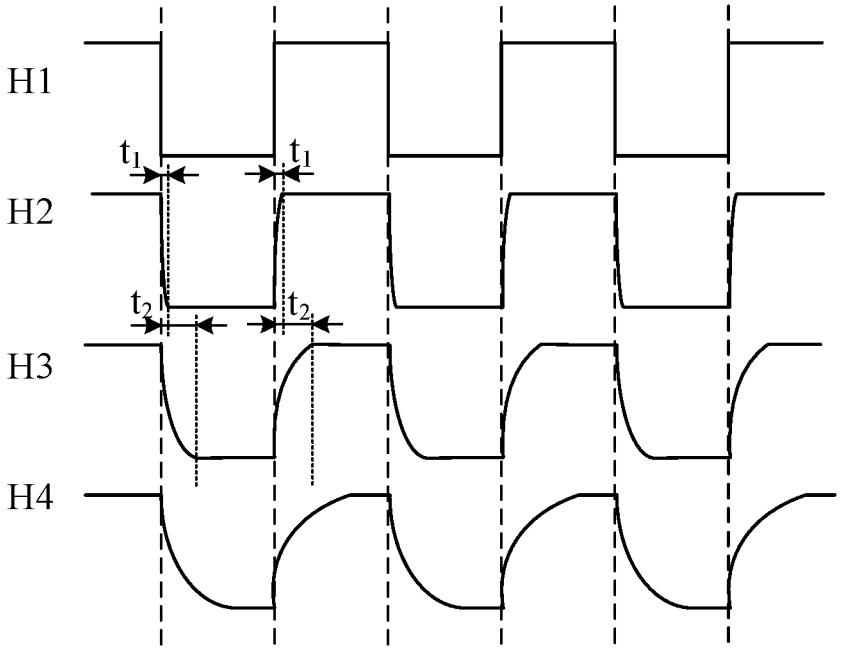
FIG. 3 illustrates a time sequence diagram of a pulse signal transmitted on a signal line.
Figure 4:
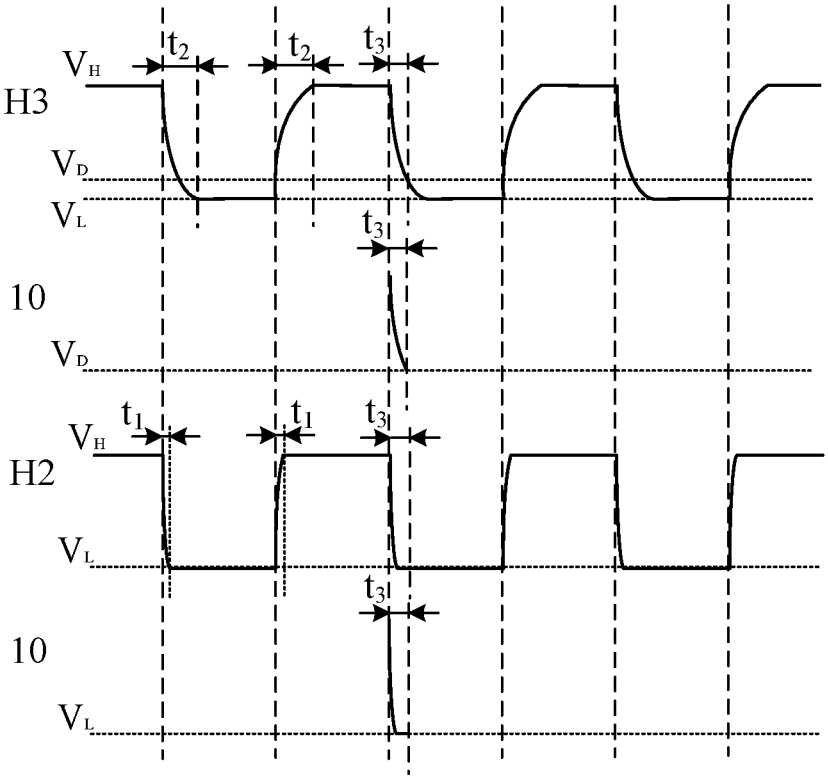
FIG. 4 illustrates a time sequence diagram of a data signal written into a data line in a detection method according to an embodiment of the present disclosure.

FIG. 1 is a schematic diagram of a display panel according to an embodiment of the present disclosure, and FIG. 2 is a flow chart of a detection method for a display panel according to an embodiment of the present disclosure. FIG. 3 illustrates a time sequence diagram of a pulse signal transmitted in a signal line. FIG. 4 illustrates a time sequence diagram of a data signal written into a data line in a detection method provided by an embodiment of the present disclosure.

As shown in FIG. 1, the display panel has a display area AA and a non-display area BA. The display area is provided with multiple data lines 10. One of the data lines is electrically connected to at least one sub-pixel sp in a pixel column. In a top view, multiple sub-pixels sp arranged in a vertical direction form a pixel column, and multiple sub-pixels sp arranged in a horizontal direction form a pixel row. The non-display area BA is provided with at least one signal line 20, at least one switch unit 30, and at least one switch control line 40. The signal line 20 is electrically connected to at least one data line 10 through the switch unit 30. The switch unit 30 includes a control terminal electrically connected to the switch control line 40, an input terminal electrically connected to the signal line 20, and an output terminal electrically connected to at least one data line 10. The switch control line 40 is configured to provide an active level signal to control the switch unit 30 to be turned on, so as to electrically connect the signal line 20 with the data line 10. The display panel according to this embodiment of the present disclosure can detect the micro-crack on the signal line 20 by using the following detection method.

As shown in FIG. 2, a detection method includes following steps.

At step S101, a pulse signal is provided to the signal line 20.

As shown in FIG. 3, H1 is a time sequence diagram of the pulse signal provided to the signal line 20; H2 is a time sequence diagram of a signal transmitted on the signal line 20 when the signal line 20 has no micro-crack; H3 is a time sequence diagram of a signal transmitted on the signal line 20 when the signal line 20 has a small crack; and H4 is a time sequence diagram of a signal transmitted on the signal line 20 when the signal line 20 has a large crack. Herein, the pulse signal includes a high-level signal and a low-level signal. If the signal line 20 has a micro-crack, the pulse signal transmitted on the signal line 20 may be delayed due to the micro-crack on the signal line 20. For example, when the pulse signal hops from a high-level signal to a low-level signal and the signal line 20 has no micro-crack, the signal on the signal line 20 hops from a high-level to a low-level after a time period of $t_1$ seconds. When the pulse signal hops from a high-level to a low-level and the signal line 20 has a micro-crack, the signal on the signal line 20 hops from a high-level to a low-level after a time period of $t_2$ seconds, where $t_2$ is longer than $t_1$. As the crack increases, the delay of the signal transmitted on the signal line 20 becomes longer.

At step S102, the switch unit 30 is controlled to be turned on once, in a period of at least one signal hopping of the pulse signal on the signal line 20, so as to electrically connect the signal line 20 with the data line 10, and to write a data signal into the data line 10 through the signal line 20. The data signal is a pulse signal truncated in the period of signal hopping of the pulse signal. For example, at the time of a signal hopping, the switch control line 40 provides an active level signal to control the switch unit 30 to be turned on, so as to electrically connect the signal line 20 with the data line 10.

Herein, the signal hopping of the pulse signal includes a hopping from a high-level signal to a low-level signal and a hopping from a low-level signal to a high-level signal. As shown in FIG. 4, a voltage of the high-level signal of the pulse signal is $V_H$, and a voltage of the low-level signal thereof is $V_L$. If the signal line 20 has a micro-crack, taking the signal line 20 transmitting the signal indicated by H3 in FIG. 3 as an example, the switch unit 30 is controlled to be turned on once, in a period of the signal hopping on the signal line 20 from a high-level to a low-level. From a moment when the signal starts to change, the switch unit 30 is controlled to be on for a time period $t_3$, where $t_3$ is shorter than $t_2$. Thus, the voltage of the data signal finally written into the data line 10 is $V_D$, where $V_L<V_D<V_H$. If the signal line 20 has no micro-crack, taking the signal line 20 transmitting the signal indicated by H2 in FIG. 3 as an example, the switch unit 30 is controlled to be turned on once in a period of the signal on the signal line 20 hopping from a high-level to a low-level. From a moment when the signal starts to change, the switch unit 30 is controlled to be on for a time period $t_3$, where $t_3$ is longer than $t_1$. Thus, the voltage of the data signal finally written into the data line 10 is $V_L$.

At step S103, the sub-pixel sp connected to the data line 10 is controlled to emit light according to the data signal; and if a brightness of the sub-pixel sp connected to the data line 10 corresponding to the signal line 20 is different from a reference brightness, it is determined that the signal line 20 has a micro-crack.

For example, the data signal is a signal truncated from the pulse signal in a period of the pulse signal hopping from a high-level signal to a low-level signal. If the signal line 20 has no micro-crack, the voltage of the data signal written into the data line 10 is $V_L$. In this case, a brightness of the sub-pixel is a reference brightness when the sub-pixel is controlled to emit light according to the data signal with a voltage of $V_L$. At this time, the low-level signal $V_L$ of the pulse signal is referred to as a reference data signal. If the signal line 20 has a micro-crack, the voltage of the data signal written into the data line 10 is $V_D$, where $V_D$ is higher than $V_L$. When the sub-pixel is controlled to emit light according to the data signal with the voltage of $V_D$, the brightness of the sub-pixel is different from the reference brightness. Therefore, it can be determined whether the signal line has a micro-crack by comparing the brightness of the sub-pixel connected to the data line corresponding to the signal line with the reference brightness. In addition, when the data signal is a signal truncated from the pulse signal in a period of the pulse signal hopping from a low-level signal to a high-level signal, a corresponding reference data signal is a high-level signal $V_H$ of the pulse signal.

In the detection method according to this embodiment of the present disclosure, a pulse signal is provided to a signal line; a signal on the signal line truncated in the hopping period is referred to as a data signal; and the sub-pixel is controlled to emit light according to the data signal. According to a phenomenon that a micro-crack on the signal line will cause a delay of the signal transmitted thereon, if the signal line has a micro-crack, the data signal written into the data line is different from the reference data signal, and the brightness of the corresponding sub-pixel is different from the reference brightness. In this way, it is determined that the signal line has a micro-crack, and the micro-crack on the signal line is detected.

Figure 5:
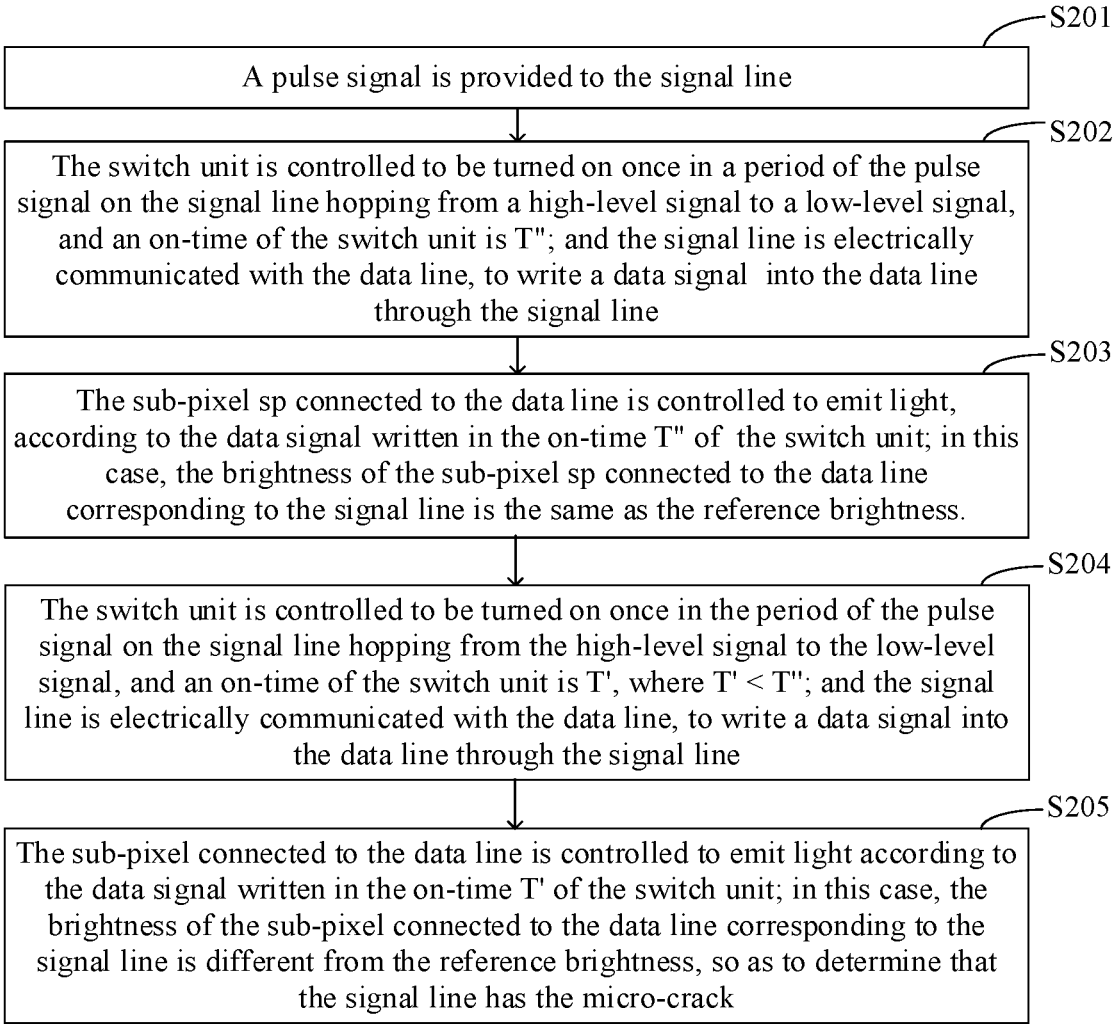
FIG. 5 is a flowchart of a detection method according to another embodiment of the present disclosure.

FIG. 5 is a flow chart of another detection method according to an embodiment of the present disclosure. As shown in FIG. 5, the detection method includes following steps.

At step S201, a pulse signal is provided to the signal line 20.

At step S202, the switch unit 30 is controlled to be turned on once in a period of the pulse signal on the signal line 20 hopping from a high-level signal to a low-level signal, and an on-time of the switch unit 30 is T"; and the signal line 20 is electrically connected with the data line 10, to write a data signal into the data line 10 through the signal line 20.

At step S203, the sub-pixel sp connected to the data line 10 is controlled to emit light, according to the data signal written in the on-time T" of the switch unit 30. In this case, the brightness of the sub-pixel sp connected to the data line 10 corresponding to the signal line 20 is the same as the reference brightness.

When the display panel is detected, a long on-time T" is set for the switch unit 30. When the switch unit 30 has the long on-time, the delay caused by the micro-crack on the signal line 20 has no influence on writing of the data signal. Taking the time sequence H3 in FIG. 4 as an example, when the on-time of the switch unit 30 is longer than $t_2$, even if the signal line 20 has a micro-crack, the voltage value of the data signal written into the data line 10 is $V_L$. That is, the written data signal is the same as the reference data signal.

At step S204, the switch unit 30 is controlled to be turned on once in a period of the pulse signal on the signal line 20 hopping from a high-level signal to a low-level signal, and an on-time of the switch unit 30 is T', where T'<T"; and the signal line 20 is electrically connected with the data line 10, to write a data signal into the data line 10 through the signal line 20.

At step S205, the sub-pixel sp connected to the data line 10 is controlled to emit light, according to the data signal written in the on-time T' of the switch unit 30. In this case, the brightness of the sub-pixel sp connected to the data line 10 corresponding to the signal line 20 is different from the reference brightness, so as to determine that the signal line 20 has the micro-crack.

When the display panel is detected, a long on-time is set for the switch unit 30 to detect the brightness of the corresponding sub-pixel, then the on-time of the switch unit 30 is gradually decreased. When the on-time of the switch unit 30 is decreased, the data signal written into the data line is a signal in a process of signal hopping. For example, the signal is truncated in a period of the signal hopping from the high-level to the low-level. If the signal line 20 has a micro-crack, a voltage of the data signal finally written into the data line 10 is greater than the voltage $V_L$ of the low-level signal, that is, the voltage of the data signal written into the data line 10 is extremely large. Then the light-emitting brightness of the sub-pixel controlled by the data signal is different from the reference brightness, so as to determine that the corresponding signal line has a micro-crack.

In the detection method according to this embodiment of the present disclosure, the signal truncated in a period of the signal hopping on the signal line is used as a data signal for controlling the sub-pixel to emit light, so as to determine whether the signal line has a micro-crack. Herein, a way for truncating the signal in the period of the signal hopping includes: truncating the signal only in a period of the signal hopping from a high-level signal to a low-level signal, truncating the signal only during a signal hopping from a low-level signal to a high-level signal, or truncating the signals both in a period of a signal hopping from a high-level signal to a low-level signal and in a period of a signal hopping from a low-level signal to a high-level signal, as data signals for driving respective sub-pixels to emit light.

Figure 6:
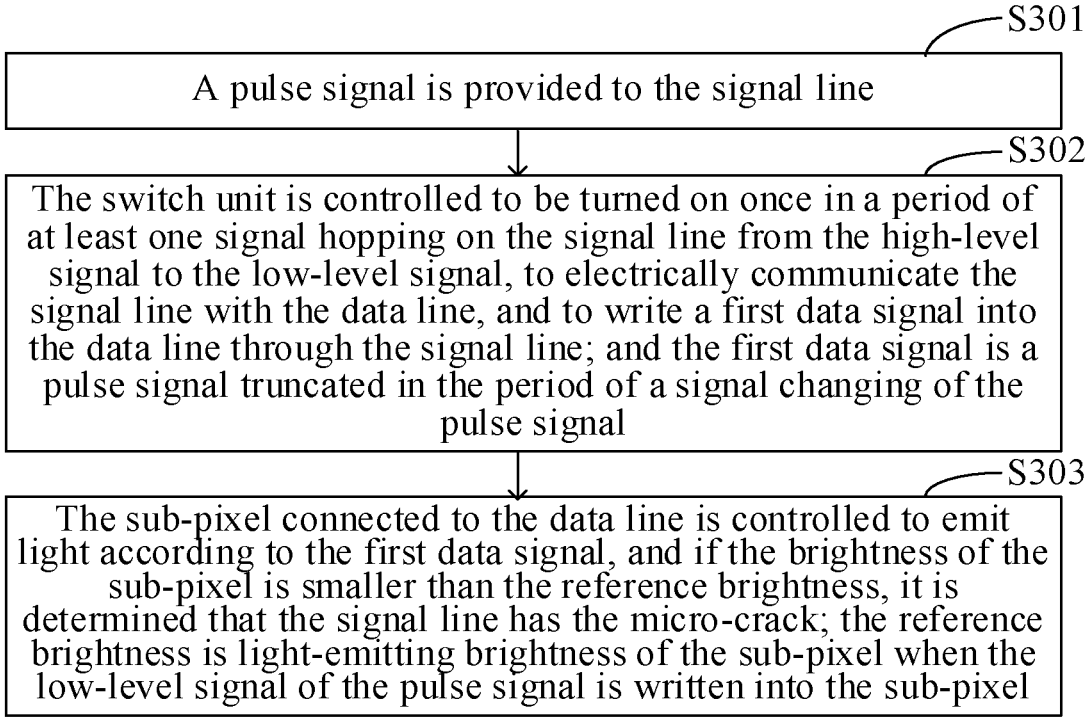
FIG. 6 is a flowchart of a detection method provided by another embodiment of the present disclosure.
Figure 7:
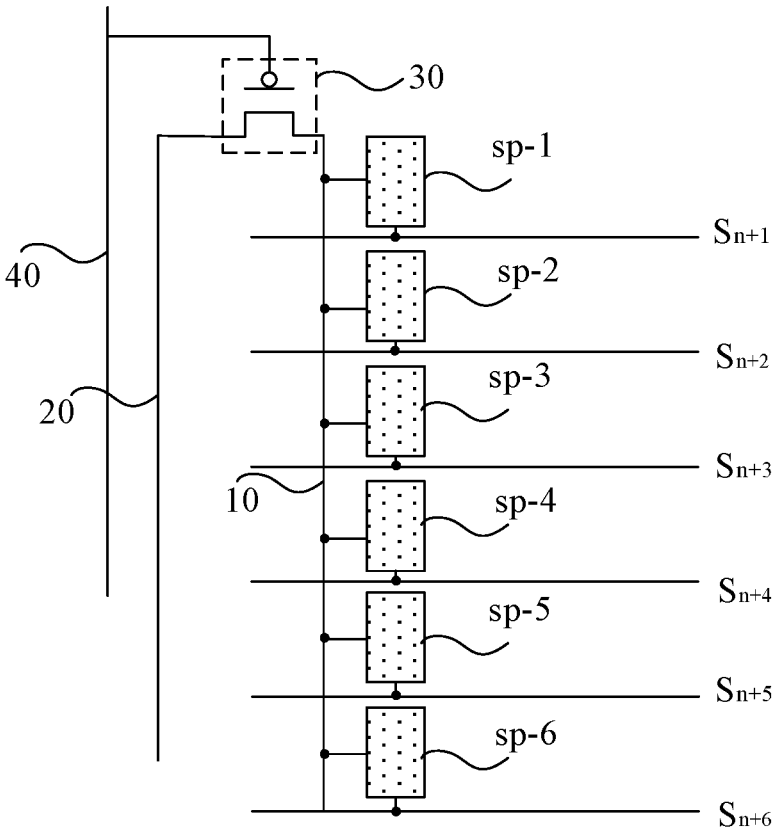
FIG. 7 is a partial simplified schematic diagram of a display panel detected by using a detection method according to an embodiment of the present disclosure.
Figure 8:
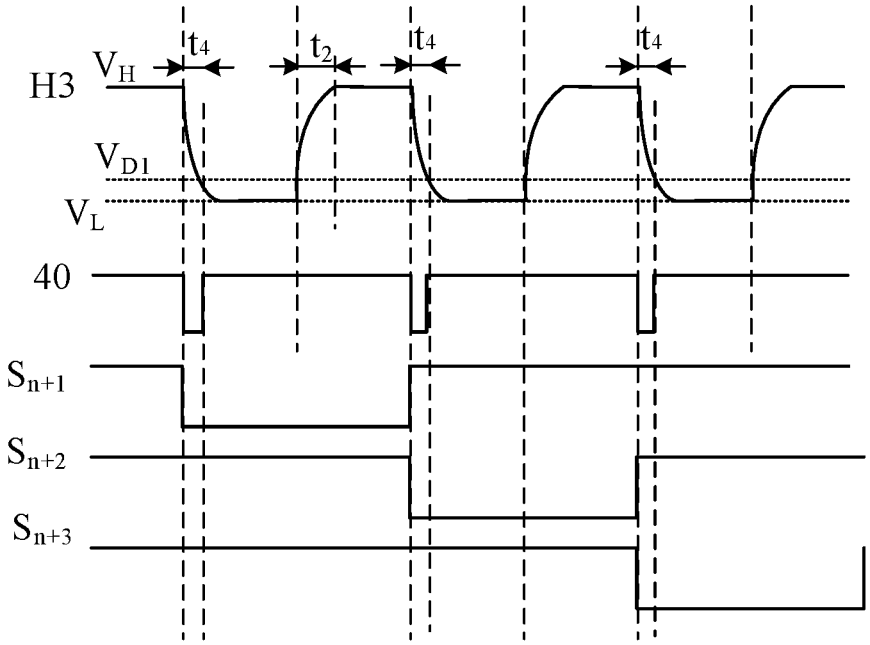
FIG. 8 illustrates a time sequence diagram of the detection method provided by the embodiment of FIG. 6.

In an embodiment, another detection method is provided. FIG. 6 is a flowchart of another detection method according to an embodiment of the present disclosure. FIG. 7 is a partial simplified schematic diagram of a display panel detected by the detection method according to an embodiment of the present disclosure. FIG. 8 illustrates a time sequence diagram of the detection method provided by the embodiment of FIG. 6.

As shown in FIG. 7, the signal line 20 is connected to the data line 10 through the switch unit 30, and a control terminal of the switch unit 30 is connected to the switch control line 40. Herein, one data line 10 is electrically connected to multiple sub-pixels sp arranged in one pixel column. In FIG. 7, the sub-pixels sp-1 to sp-6 connected to the data line 10 are shown. The display panel further includes a plurality of scan lines, and one scan line is electrically connected to multiple sub-pixels arranged in one pixel row. FIG. 7 shows scan lines $S_{n+1}$ to $S_{n+6}$, where n is a positive integer. The step S103 of controlling the sub-pixel connected to the data line to emit light according to the data signal includes: providing a scan signal to the scan line, writing the data signal to the sub-pixel under the control of the scan signal, to control the sub-pixel connected to the data line to emit light. That is, the scan signal is provided to the sub-pixel through the scan line, so as to write the data signal into the sub-pixel.

As shown in FIG. 6, the detection method includes following steps.

At step S301, a pulse signal is provided to the signal line 20.

At step S302, the switch unit 30 is controlled to be turned on once in a period of at least one signal hopping on the signal line 20 from a high-level signal to a low-level signal; the signal line 20 is electrically connected with the data line 10; and a first data signal is written into the data line 10 through the signal line 20. Herein, the first data signal is the pulse signal truncated in a period of the signal hopping from the high-level signal to the low-level signal.

Herein, the data signal is written into the data line 10 once when the switch unit 30 is turned on once. In an embodiment, by comparing the brightness of one sub-pixel with the reference brightness, it is determined whether the corresponding signal line has the micro-crack. In another embodiment, by comparing the brightness of each of the sub-pixels connected to one data line with the reference brightness, it is determined whether the corresponding signal line has a micro-crack. During the detection, the signal hopping from the high-level signal to the low-level signal occurs many times, and the switch unit 30 is controlled to be turned on once in each time of signal hopping, so as to write multiple data signals into one data line 10.

At step S303, the sub-pixel sp connected to the data line 10 is controlled to emit light according to the first data signal. If the brightness of the sub-pixel sp is less than the reference brightness, it is determined that the signal line 20 has the micro-crack. The reference brightness is light-emitting brightness of the sub-pixel sp when a low-level signal of the pulse signal is written into the sub-pixel sp.

As shown in FIG. 8, taking the time sequence of the signal on the signal line 20 being H3 in FIG. 3 as an example, the switch control line 40 provides an active level signal in each period of the signal hopping from the high-level signal $V_H$ to the low-level signal $V_L$, so as to control the switch unit 30 to be turned on once. An on-time of the switch unit 30 is $t_4$, where $t_4$ is shorter than $t_2$. Then, a voltage of the first data signal written into the data line 10 through the signal line 20 is $V_{D1}$, where $V_L<V_{D1}$. According to a calculation formula of a light-emitting current Id in organic light-emitting display technology, $Id=K*(Vpvdd-Vdata)^2$, where K is a constant, Vpvdd is a positive power voltage value, and Vdata is a voltage of the data signal written into the sub-pixel. The greater the voltage of the data signal written into the sub-pixel, the less the light-emitting brightness of the sub-pixel. When the first data signal controls the sub-pixel to emit light with a brightness less than the reference brightness, it is determined that the signal line 20 has the micro-crack.

In the detection method provided by this embodiment, the switch unit is controlled to be turned on once in a period of the pulse signal on the signal line hopping from the high-level signal to the low-level signal, so as to write the first data signal into the data line. If the signal line has the micro-crack, the micro-crack will cause a delay of the signal on the signal line, the voltage of the first data signal written into the data line is higher than the voltage of the low-level signal of the pulse signal. Thus, the light-emitting brightness of the sub-pixel controlled according to the first data signal is less than the light-emitting brightness of the sub-pixel controlled according to the low-level signal of the pulse signal. That is, when the light-emitting brightness of the detected sub-pixel is relatively small, it is determined that the signal line has the micro-crack.

With reference to the time sequence of scan lines $S_{n+1}$ to $S_{n+3}$ in the time sequence diagram of FIG. 8 and a connection manner of the scan lines and the sub-pixels arranged in the pixel column shown in FIG. 7, the following embodiment will be described. The scan lines $S_{n+1}$ to $S_{n+3}$ are sequentially arranged. The period during which a scan signal is provided to each scan line overlaps the period during which the switch control line 40 provides an active level signal. The scan line $S_{n+1}$ is connected to the sub-pixel sp-1, the scan line $S_{n+2}$ is connected to the sub-pixel sp-2, and the scan line $S_{n+3}$ is connected to the sub-pixel sp-3. At the first time that the switch control line 40 provides the active level signal to control the switch unit 30 to be turned on once, the truncated first data signal is written into the sub-pixel sp-1. At the second time that the switch control line 40 provides the active level signal to control the switch unit 30 to be turned on once, the truncated first data signal is written into the sub-pixel sp-2. At the third time that the switch control line 40 provides the active level signal to control the switch unit 30 to be turned on once, the truncated first data signal is written into the sub-pixel sp-3. In this embodiment, multiple data signals written into the data line 10 are sequentially provided to the pixels sp in the pixel column. That is, multiple sub-pixels sp in the pixel column are sequentially controlled to emit light according to the data signals. If the signal line 20 has the micro-crack, multiple first data signals truncated in periods of the signal hopping from the high-level signal to the low-level signal are respectively written into the sub-pixels arranged in the pixel column. When a column light-emitting brightness of the pixel column is less than the reference brightness, that is, when the column light-emitting brightness of the pixel column is relatively small, it is determined that the signal line has the micro-crack.

In the detection method shown in the time sequence diagram of FIG. 8, the data signals are sequentially written into the sub-pixels which are sequentially arranged in the pixel column. Thus, all of the sub-pixels sequentially arranged in the pixel column emit light in the detection process.

Figure 9:
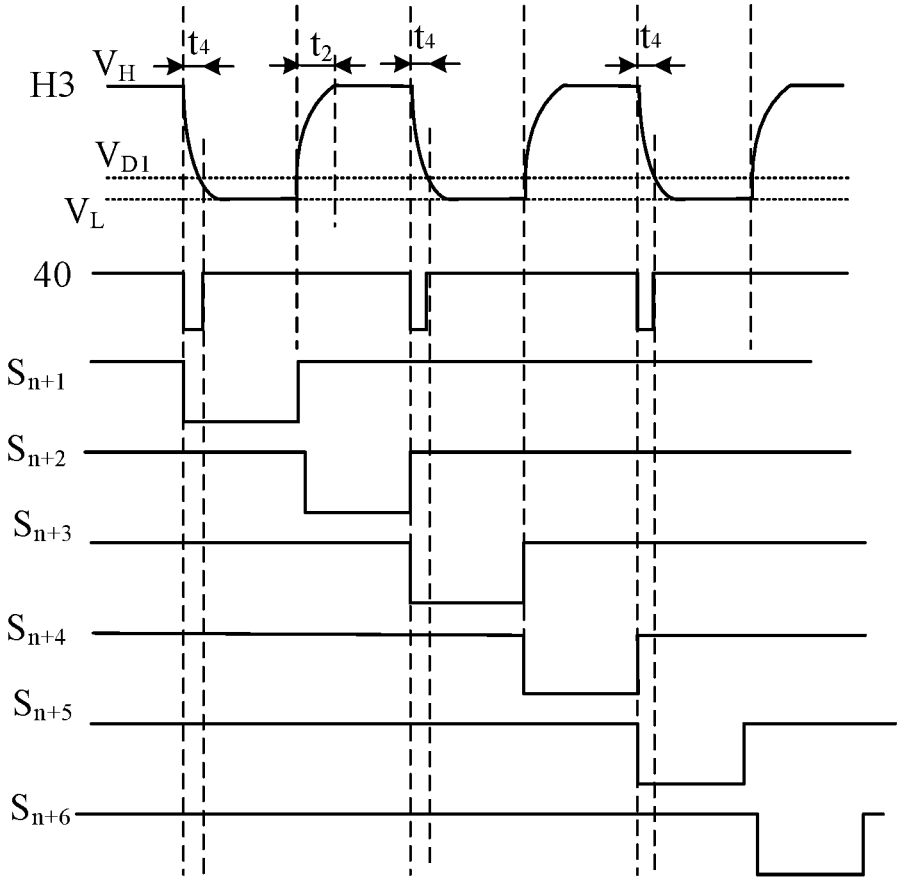
FIG. 9 illustrates another time sequence diagram of the detection method provided by the embodiment of FIG. 6.

In another embodiment, multiple sub-pixels arranged in one pixel column include a detection sub-pixel and a non-detection sub-pixel. The step S103 of controlling the sub-pixel connected to the data line to emit light according to the data signal includes: controlling the detection sub-pixels in the pixel column to emit light according to multiple data signals. That is, only a part of the sub-pixels in the pixel column emit light in the detection process. FIG. 9 illustrates another time sequence diagram of the detection method provided by the embodiment of FIG. 6. With reference to a connection manner of the scan line and the sub-pixels in the pixel column shown in FIG. 7, the embodiment will be described. As shown in FIG. 9, in each period of the signal hopping from the high-level signal $V_H$ to the low-level signal $V_L$, the switch control line 40 provides an active level signal to control the switch unit 30 to be turned on once. An on-time of the switch unit 30 is $t_4$, where $t_4$ is shorter than $t_2$. In this case, the voltage of the first data signal written into the data line 10 through the signal line 20 is $V_{D1}$. The periods in which the scan signals are provided to the scan line $S_{n+1}$, the scan line $S_{n+3}$, and the scan line $S_{n+5}$ overlap the period in which the switch control line 40 provides the active level signal. The scan line $S_{n+1}$ is connected to the sub-pixel sp-1, the scan line $S_{n+3}$ is connected to the sub-pixel sp-3, and the scan line $S_{n+5}$ is connected to the sub-pixel sp-5. At the first time that the switch control line 40 provides the active level signal to control the switch unit 30 to be turned on once, the truncated first data signal is written into the sub-pixel sp-1. At the second time that the switch control line 40 provides the active level signal to control the switch unit 30 to be turned on once, the truncated first data signal is written into the sub-pixel sp-3. At the third time that the switch control line 40 provides the active level signal to control the switch unit 30 to be turned on once, the truncated first data signal is written into the sub-pixel sp-5. In this embodiment, the sub-pixel sp-1, the sub-pixel sp-3, and the sub-pixel sp-5 are the detection sub-pixels; and the sub-pixel sp-2, the sub-pixel sp-4, and the sub-pixel sp-6 are the non-detection sub-pixels. No data signal is written into the data line 10 in the periods that the scan signals are provided to the scan line $S_{n+2}$, the scan line $S_{n+4}$, and the scan line $S_{n+6}$. Thus, the sub-pixels connected to the scan line $S_{n+2}$, the scan line $S_{n+4}$, and the scan line $S_{n+6}$ will not emit light. By comparing the brightness of the sub-pixel sp-1, the brightness of the sub-pixel sp-3, and the brightness of the sub-pixel sp-5 with the reference brightness, it is determined whether the signal line 20 has the micro-crack. In the detection method provided by this embodiment, the detection sub-pixels arranged in the pixel column (some of the sub-pixels arranged in the pixel column) are controlled to emit light according to multiple data signals, so as to determine whether the signal line has the micro-crack.

Figure 10:
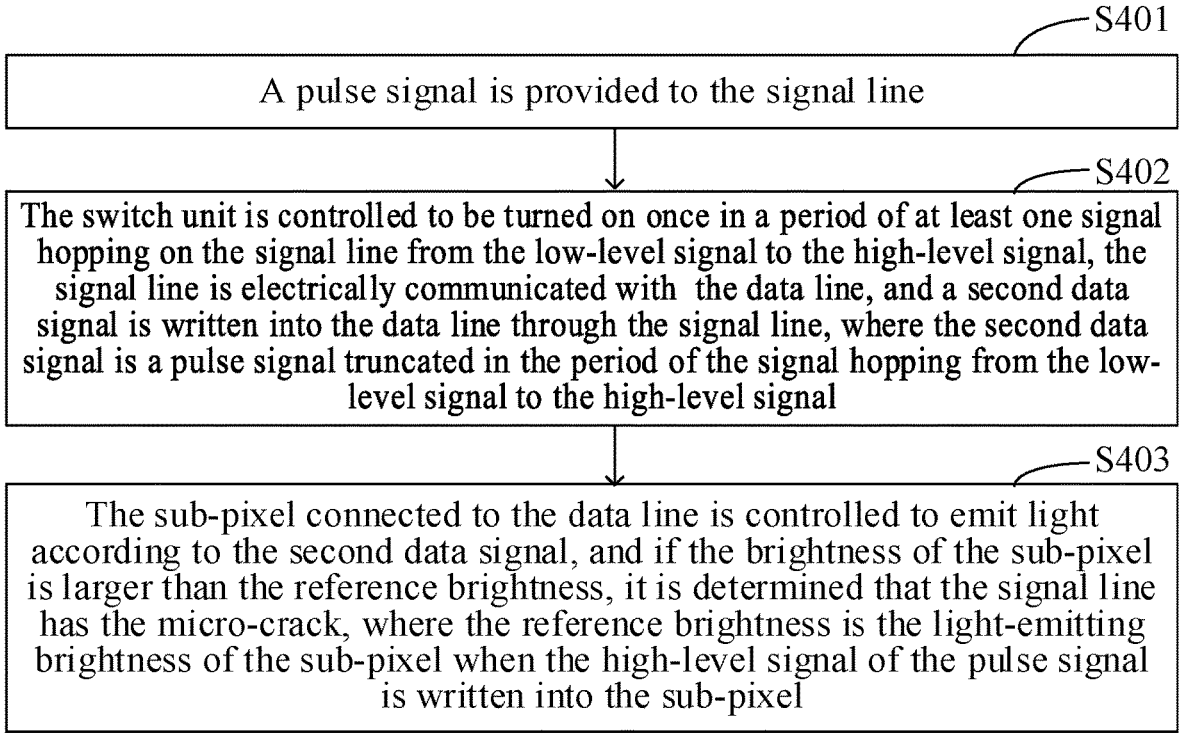
FIG. 10 is a flowchart of a detection method provided by another embodiment of the present disclosure.
Figure 11:
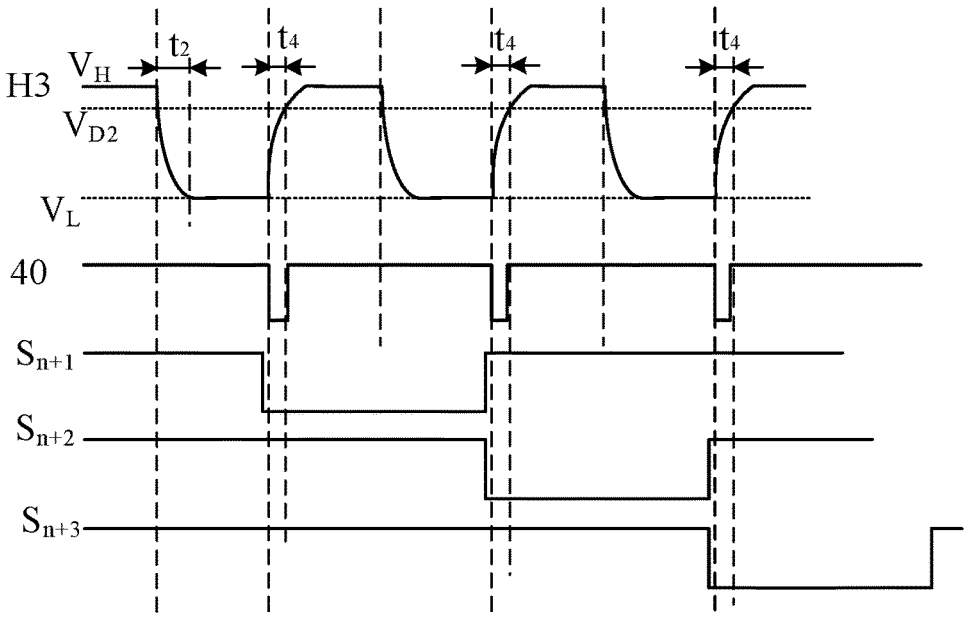
FIG. 11 illustrates a time sequence diagram of the detection method provided by the embodiment of FIG. 10.

FIG. 10 is a flowchart of a detection method according to another embodiment of the present disclosure. FIG. 11 illustrates a time sequence diagram of the detection method provided by the embodiment of FIG. 10. In an embodiment, as shown in FIG. 10, the detection method includes the following steps.

At step S401, a pulse signal is provided to the signal line 20.

At step S402, the switch unit 30 is controlled to be turned on once, in a period of at least one signal hopping on the signal line from a low-level signal to a high-level signal, the signal line 20 is electrically connected with the data line 10, and a second data signal is written into the data line 10 through the signal line 20. Herein, the second data signal is a pulse signal truncated in the period of the signal hopping from the low-level signal to the high-level signal.

In an embodiment, by comparing the brightness of one sub-pixel with the reference brightness, it is determined whether the corresponding signal line has the micro-crack. In another embodiment, by comparing the brightness of the sub-pixels connected to one data line with the reference brightness, it is determined whether the corresponding signal line has the micro-crack. In the detection process, the signal hopping from the low-level signal to the high-level signal occurs many times, and the switch unit 30 is controlled to be turned on once in each time of signal hopping, so as to write multiple data signals into one data line 10.

At step S403, the sub-pixel sp connected to the data line 10 is controlled to emit light according to the second data signal. If the brightness of the sub-pixel sp is greater than the reference brightness, it is determined that the signal line 20 has the micro-crack. The reference brightness is the light-emitting brightness of the sub-pixel sp when a high-level signal of the pulse signal is written into the sub-pixel sp.

As shown in FIG. 11, taking the time sequence of the signal on the signal line 20 being H3 in FIG. 3 as an example, the switch control line 40 provides an active level signal in each period of the signal hopping from the low-level signal $V_L$ to the high-level signal $V_H$, so as control the switch unit 30 to be turned on once. An on-time of the switch unit 30 is $t_4$, where $t_4$ is shorter than $t_2$. Then, a voltage of the second data signal written into the data line 10 through the signal line 20 is $V_{D2}$, where $V_{D2}<V_H$. According to a calculation formula of a light-emitting current Id in organic light-emitting display technology, the less the voltage of the data signal written into the sub-pixel, the greater the light-emitting brightness of the sub-pixel. When the second data signal controls the sub-pixel to emit light with a brightness greater than the reference brightness, it is determined that the signal line 20 has the micro-crack.

In the detection method provided by this embodiment, the switch unit is controlled to be turned on once in a period of the pulse signal on the signal line hopping from the low-level signal to the high-level signal, so as to write the second data signal into the data line. If the signal line has the micro-crack, the micro-crack will cause a delay of the signal on the signal line, the voltage of the second data signal written into the data line is lower than the voltage of the high-level signal of the pulse signal. Thus, the light-emitting brightness of the sub-pixel controlled according to the second data signal is greater than the light-emitting brightness of the sub-pixel controlled according to the high-level signal of the pulse signal. That is, when the light-emitting brightness of the detected sub-pixel is relatively large, it is determined that the signal line has the micro-crack.

With reference to the time sequence of scan lines $S_{n+1}$ to $S_{n+3}$ in the time sequence diagram of FIG. 11 and a connection manner of the scan lines and the sub-pixels arranged in the pixel column shown in FIG. 7, the following embodiment will be described. The scan lines $S_{n+1}$ to $S_{n+3}$ are sequentially arranged. The period during which a scan signal is provided to each scan line overlaps the period during which the switch control line 40 provides the active level signal. At the first time that the switch control line 40 provides the active level signal to control the switch unit 30 to be turned on once, the truncated first data signal is written into the sub-pixel sp-1. At the second time that the switch control line 40 provides the active level signal to control the switch unit 30 to be turned on once, the truncated first data signal is written into the sub-pixel sp-2. At the third time that the switch control line 40 provides the active level signal to control the switch unit 30 to be turned on once, the truncated first data signal is written into the sub-pixel sp-3. In this embodiment, multiple data signals written into the data line 10 are sequentially provided to the sub-pixels sp in the pixel column. That is, multiple sub-pixels sp in the pixel column are sequentially controlled to emit light according to the data signals. If the signal line 20 has the micro-crack, multiple second data signals truncated in periods of the signal hopping from the low-level signal to the high-level signal are respectively written into the sub-pixels arranged in the pixel column.

When a column light-emitting brightness of the pixel column is greater than the reference brightness, that is, when the column light-emitting brightness of the pixel column is relatively large, it is determined that the signal line has the micro-crack.

Figure 12:
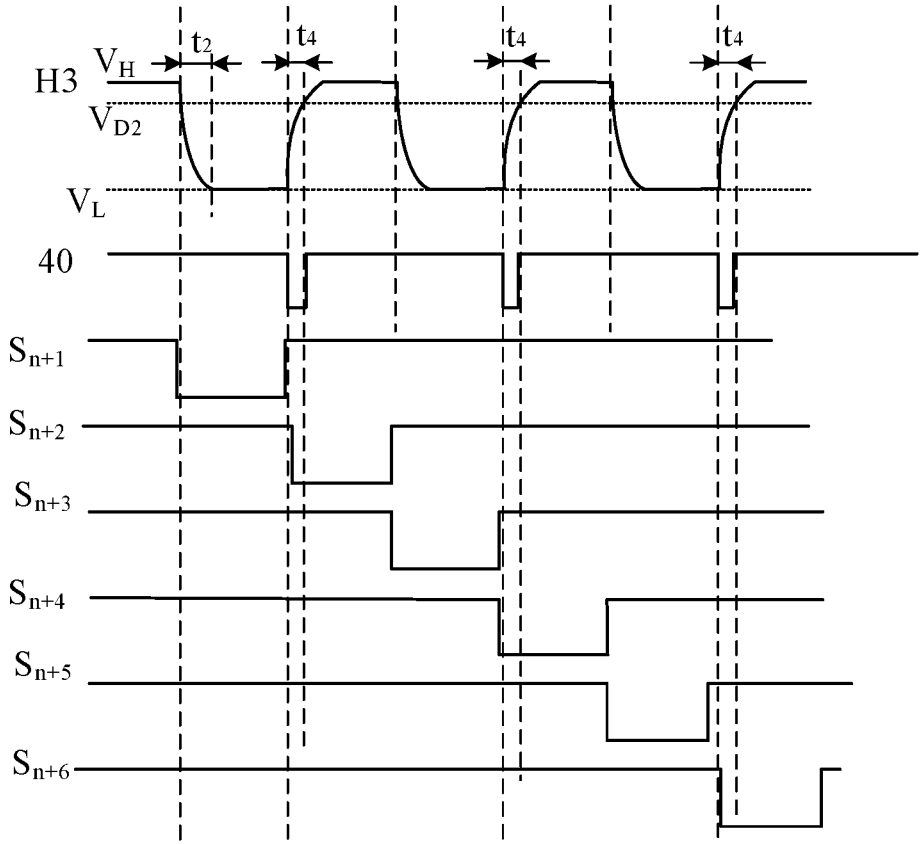
FIG. 12 illustrates another time sequence diagram of the detection method provided by the embodiment of FIG. 10.

In the detection method shown in the time sequence diagram of FIG. 11, the data signals are sequentially written into the sub-pixels which are sequentially arranged in the pixel column. Thus, all of the sub-pixels sequentially arranged in the pixel column emit light in the detection process. In another embodiment, multiple sub-pixels arranged in one pixel column include a detection sub-pixel and a non-detection sub-pixel. The step S103 of controlling the sub-pixel connected to the data line to emit light according to the data signal includes: controlling the detection sub-pixels in the pixel column to emit light according to multiple data signals. That is, only a part of the sub-pixels in the pixel column emits light in the detection process. FIG. 12 illustrates another time sequence diagram of the detection method provided by the embodiment of FIG. 10. With reference to a connection manner of the scan line and the sub-pixels in the pixel column shown in FIG. 7, the embodiment will be described. As shown in FIG. 12, in each period of the signal hopping from the low-level signal $V_L$ to the high-level signal $V_H$, the switch control line 40 provides the active level signal to control the switch unit 30 to be turned on once. An on-time of the switch unit 30 is $t_4$, where $t_4$ is shorter than $t_2$. In this case, the voltage of the second data signal written into the data line 10 through the signal line 20 is $V_{D2}$. The periods in which the scan signals are provided to the scan line $S_{n+2}$, the scan line $S_{n+4}$, and the scan line $S_{n+6}$ overlap the period in which the switch control line 40 provides the active level signal. The scan line $S_{n+2}$ is connected to the sub-pixel sp-2, the scan line $S_{n+4}$ is connected to the sub-pixel sp-4, and the scan line $S_{n+6}$ is connected to the sub-pixel sp-6. At the first time that the switch control line 40 provides the active level signal to control the switch unit 30 to be turned on once, the truncated second data signal is written into the sub-pixel sp-2. At the second time that the switch control line 40 provides the active level signal to control the switch unit 30 to be turned on once, the truncated second data signal is written into the sub-pixel sp-4. At the third time that the switch control line 40 provides the active level signal to control the switch unit 30 to be turned on once, the truncated second data signal is written into the sub-pixel sp-6. In this embodiment, the sub-pixel sp-2, the sub-pixel sp-4, and the sub-pixel sp-6 are the detection sub-pixels; and the sub-pixel sp-1, the sub-pixel sp-3, and the sub-pixel sp-5 are the non-detection sub-pixels. No data signal is written into the data line 10 in the periods that the scan signals are provided to the scan line $S_{n+1}$, the scan line $S_{n+3}$, and the scan line $S_{n+5}$. Thus, the sub-pixels connected to the scan line $S_{n+1}$, the scan line $S_{n+3}$, and the scan line $S_{n+5}$ will not emit light. By comparing the brightness of the sub-pixel sp-2, the brightness of the sub-pixel sp-4, and the brightness of the sub-pixel sp-6 with the reference brightness, it is determined whether the signal line 20 has the micro-crack. In the detection method provided by this embodiment, the detection sub-pixels arranged in the pixel column (some of the sub-pixels arranged in the pixel column) are controlled to emit light according to multiple data signals, so as to determine whether the signal line has the micro-crack.

Figure 13:
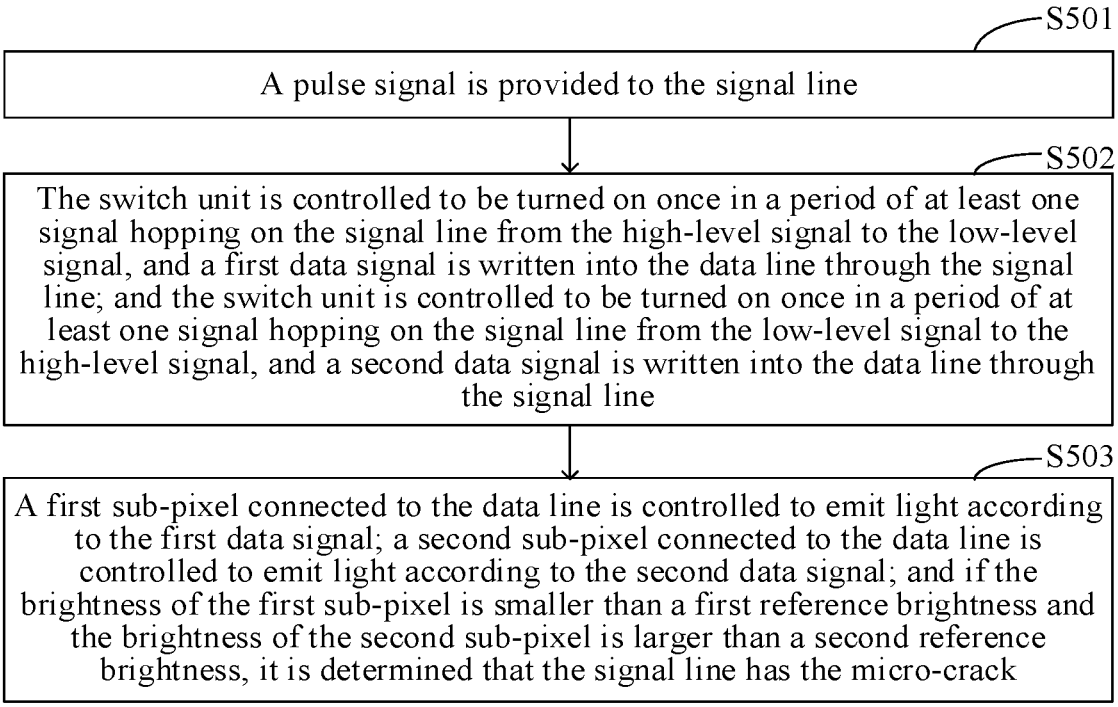
FIG. 13 is a flowchart of a detection method according to another embodiment of the present disclosure.

FIG. 13 is a flowchart of a detection method according to another embodiment of the present disclosure. In an embodiment, as shown in FIG. 13, the detection method includes the following steps.

At step S501, a pulse signal is provided to the signal line 20.

At step S502, the switch unit 30 is controlled to be turned on once, in a period of at least one signal hopping on the signal line from a high-level signal to a low-level signal, and a first data signal is written into the data line 10 through the signal line 20; and the switch unit 30 is controlled to be turned on once in a period of at least one signal hopping on the signal line from a low-level signal to a high-level signal, and a second data signal is written into the data line 10 through the signal line 20. Herein, the first data signal is a pulse signal truncated in a period of the pulse signal hopping from the high-level signal to the low-level signal, and the second data signal is a pulse signal truncated in a period of the pulse signal hopping from the low-level signal to the high-level signal.

At step S503, a first sub-pixel connected to the data line 10 is controlled to emit light according to the first data signal; a second sub-pixel connected to the data line 10 is controlled to emit light according to the second data signal; and if the brightness of the first sub-pixel is less than a first reference brightness and the brightness of the second sub-pixel is greater than a second reference brightness, it is determined that the signal line 10 has the micro-crack. Herein, the first reference brightness is a light-emitting brightness of the sub-pixel when a low-level signal of the pulse signal is written into the sub-pixel, and the second reference brightness is a light-emitting brightness of the sub-pixel when a high-level signal of the pulse signal is written into the sub-pixel. The low-level signal of the pulse signal is a first reference data signal, and the high-level signal of the pulse signal is a second reference data signal.

According to the description in the above-mentioned embodiments of FIG. 6 and FIG. 10, it can be understood that if the signal line 20 has a micro-crack, when the switch unit 30 is controlled to be turned on once in the period of the signal hopping on the signal line 20 from the high-level signal to the low-level signal, the voltage of the first data signal written into the data line 10 is higher than the voltage $V_L$ of the low-level signal of the pulse signal; when the switch unit 30 is controlled to be turned on once in the period of the signal hopping on the signal line 20 from the low-level signal to the high-level signal, the voltage of the second data signal written into the data line 10 is lower than the voltage $V_H$ of the high-level signal of the pulse signal. The first sub-pixel is controlled to emit light according to the first data signal, and the second sub-pixel is controlled to emit light according to the second data signal. The light-emitting brightness of the sub-pixel when the low-level signal of the pulse signal is written into the sub-pixel is referred to as a first reference brightness. The light-emitting brightness of the sub-pixel when the high-level signal of the pulse signal is written into the sub-pixel is referred to as a second reference brightness. By comparing the brightness of the first sub-pixel with the first reference brightness and comparing the brightness of the second sub-pixel and the second reference brightness, it can be determined whether the signal line has the micro-crack.

Figure 14:
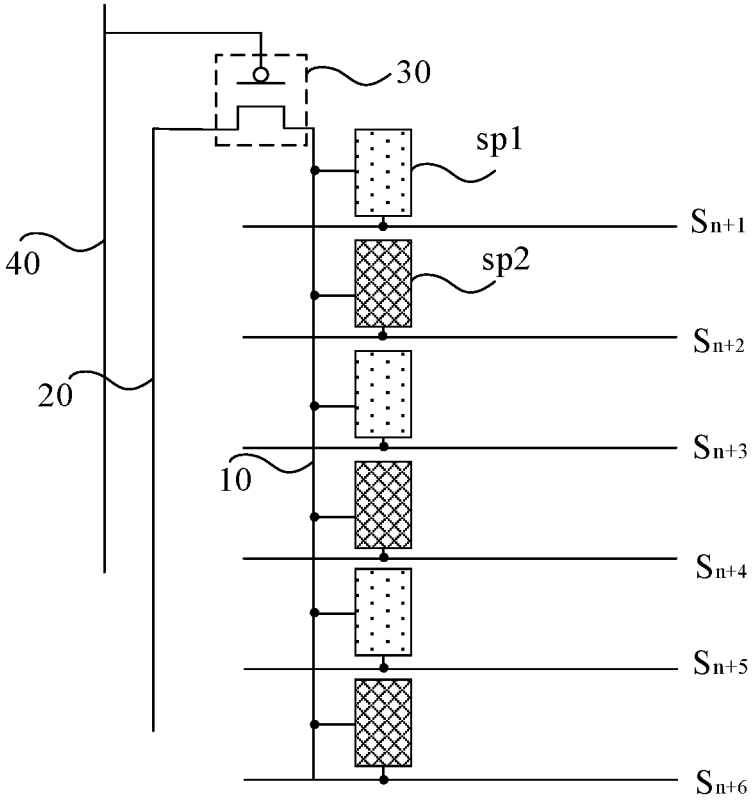
FIG. 14 is a partial simplified schematic diagram of a display panel according to another embodiment of the present disclosure.
Figure 15:
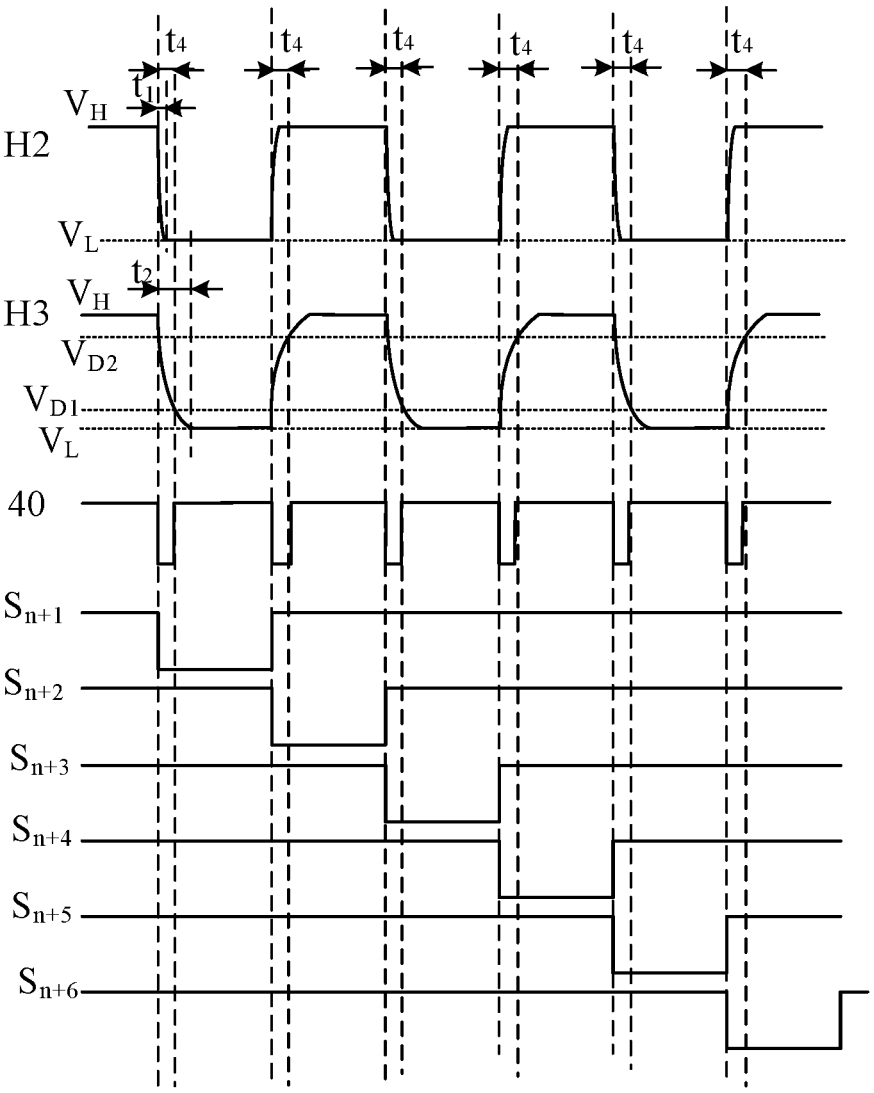
FIG. 15 illustrates another time sequence diagram in the detection method provided by an embodiment of the present disclosure.

In an embodiment, the step S502 includes: alternately performing the step of controlling the switch unit to be turned on once in the period of the signal hopping on the signal line from the high-level signal to the low-level signal, and the step of controlling the switch unit to be turned on once in the period of a signal hopping on the signal line from the low-level signal to the high-level signal. FIG. 14 is a partial simplified schematic diagram of another display panel provided by an embodiment of the present disclosure. The signal line in the display panel provided by the embodiment of FIG. 14 can be detected by the detection method provided by this embodiment. FIG. 15 illustrates another time sequence diagram in a detection method provided by an embodiment of the present disclosure.

As shown in FIG. 14, the signal line 20 is connected to the data line 10 through the switch unit 30, and the control terminal of the switch unit 30 is connected to the switch control line 40. Herein, the pixel column connected to the data line 10 includes at least one first sub-pixel sp1 and at least one second sub-pixel sp2, and the first sub-pixel sp1 and the second sub-pixel sp2 are alternately arranged. The display panel further includes multiple scan lines. One scan line is electrically connected to multiple sub-pixels arranged in one pixel row. FIG. 14 shows scan lines $S_{n+1}$ to $S_{n+6}$, where n is a positive integer. The step S103 of controlling the sub-pixel connected to the data line to emit light according to the data signal includes: providing a scan signal to the scan line, and writing the data signal into the sub-pixel under the control of the scan signal, to control the sub-pixel connected to the data line to emit light.

As shown in FIG. 15, in an example, the signal transmitted on the signal line 20 without the micro-crack is H2 shown in FIG. 3; the signal transmitted on the signal line 20 with the micro-crack is H3 shown in FIG. 3. As shown in FIG. 15, a pulse width of the scan signal provided to the scan line is approximately equal to a pulse width of the pulse signal transmitted on the signal line. Moreover, a period in which the scan signal is transmitted on the scan line overlaps a period in which the switch control line 40 provides the active level signal. The switch unit 30 is controlled to be turned on once in a period of a signal hopping on the signal line 20, so as to write the data signal into the data line 20. When the data signal is written into the data line 20, a scan signal is meanwhile provided to the sub-pixel through the scan line, and the data signal on the data line 20 is written into the sub-pixel to control the sub-pixel to emit light. Taking a falling period of the signal hopping on the signal line 20 from the high-level signal to the low-level signal shown in FIG. 15 as an example, the switch control line 40 provides the active level signal and a scan signal is transmitted in the scan line $S_{n+1}$ in the falling period. The switch unit 30 is turned on once to write into the data line 10 the pulse signal (i.e., data signal) truncated in the period $t_4$ of the signal hopping from the high-level signal to the low-level signal. At this time, the data signal is provided to the first sub-pixel sp1 connected to scan line $S_{n+1}$ shown in FIG. 14, through the data line 10.

In the period of the signal hopping on the signal line from the high-level signal $V_H$ to the low-level signal $V_L$, the active level signal is provided through the switch control line 40 to control the switch unit 30 to be turned on once. In the period of the signal hopping on the signal line from the low-level signal $V_L$ to the high-level signal $V_H$, the active level signal is provided through the switch control line 40 to control the switch unit 30 to be turned on once. The on-time of the switch unit 30 is $t_4$, where $t_4$ is shorter than $t_2$.

In the case that the signal line 20 has no micro-crack, in the period of the signal hopping from the high-level signal $V_H$ to the low-level signal $V_L$, the voltage of the first data signal written into the data line 10 through the signal line 20 is $V_L$; and in the period of the signal hopping from the low-level signal $V_L$ to the high-level signal $V_H$, the voltage of the second data signal written into the data line 10 through the signal line 20 is $V_H$. The first sub-pixel sp1 is controlled to emit light according to the first data signal, and the second sub-pixel sp2 is controlled to emit light according to the second data signal. In this case, the light-emitting brightness of the first sub-pixel sp1 is the first reference brightness, and the brightness of the second sub-pixel sp2 is the second reference brightness.

In the case that the signal line 20 has a micro-crack, in the period of the signal hopping from the high-level signal $V_H$ to the low-level signal $V_L$, the voltage of the first data signal written into the data line 10 through the signal line 20 is $V_{D1}$, where $V_L<V_{D1}$; and in the period of the signal hopping from the low-level signal $V_L$ to the high-level signal $V_H$, the voltage of the second data signal written into the data line 10 through the signal line 20 is $V_{D2}$, where $V_{D2}<V_H$. The first sub-pixel sp1 is controlled to emit light according to the first data signal, and the second sub-pixel sp2 is controlled to emit light according to the second data signal. The light-emitting brightness of the first sub-pixel sp1 controlled by the first data signal is less than the first reference brightness, and the light-emitting brightness of the second sub-pixel sp2 controlled by the second data signal is greater than the second reference brightness. Therefore, it is determined that the signal line has the micro-crack.

Figure 16:
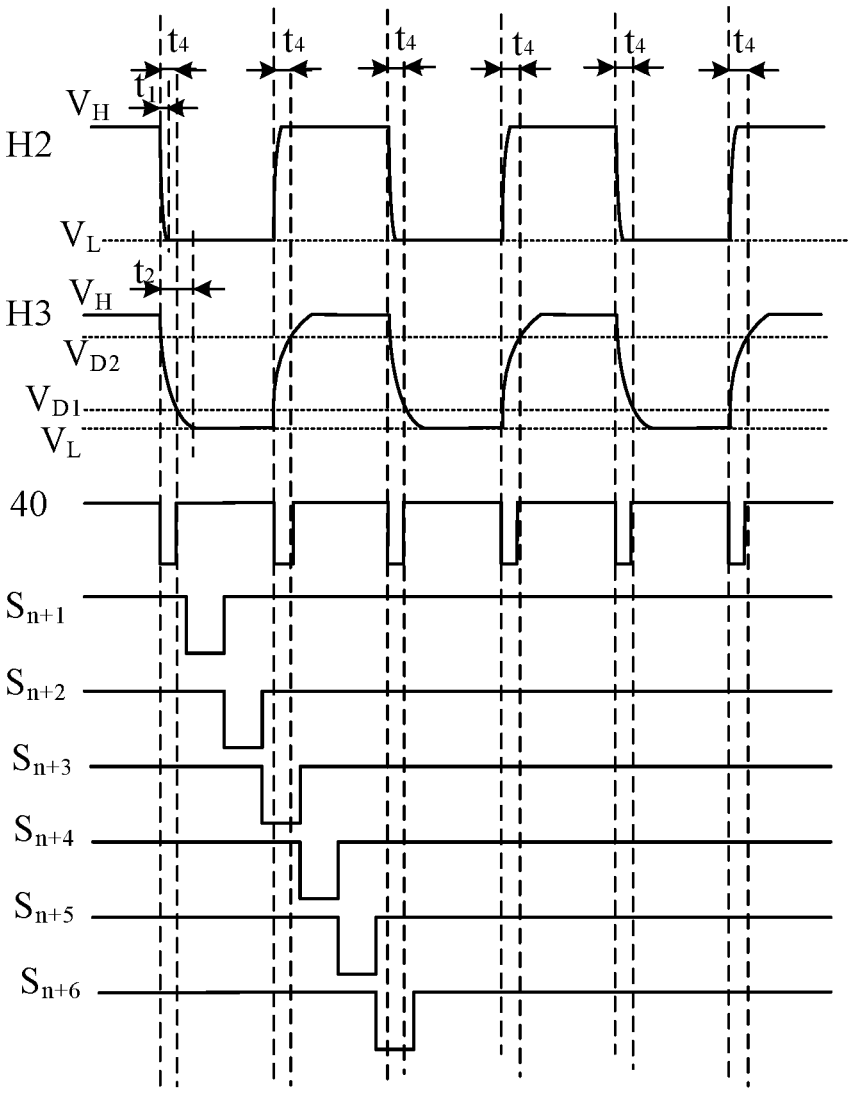
FIG. 16 illustrates another time sequence diagram in the detection method provided by an embodiment of the present disclosure.

In the detection method shown in the time sequence diagram of FIG. 15, the first data signal and the second data signal are alternately written into the data line, then the data signals are sequentially written into multiple sub-pixels arranged in the pixel column. All the sub-pixels sequentially arranged in the column will emit light in the detection process. In another time sequence diagram, only a part of the sub-pixels in the pixel column emit light in the detection process. FIG. 16 illustrates another time sequence diagram in a detection method provided by an embodiment of the present disclosure. With reference to a connection manner of the scan lines and the sub-pixels in the pixel column shown in FIG. 7, the following embodiment will be described. As shown in FIG. 16, under the control of the switch control line 40, the step of controlling the switch unit 30 to be turned on once in the period of the signal hopping on the signal line 20 from the high-level signal to the low-level signal and the step of controlling the switch unit 30 to be turned on once in the period of the signal hopping on the signal line 20 from the low-level signal to the high-level signal are alternately performed. A pulse width of the scan signal is less than a pulse width of the pulse signal. At the first time that the switch control line 40 provides the active level signal, the truncated first data signal is written into the data line 10, and the first data signal is written into the sub-pixel sp-1 at the moment of providing a scan signal on the scan line $S_{n+1}$. No data signal is written into the data line when the scan signal is provided on the scan line $S_{n+2}$. Thus, the sub-pixel sp-2 connected to the scan line $S_{n+2}$ does not emit light. For the same reason, it can be understood that in the detection process, the second data signal is controlled to be written into the sub-pixel sp-3 at the moment of providing a scan signal on the scan line $S_{n+3}$, and the first data signal is controlled to be written into the sub-pixel sp-6 at the moment of providing a scan signal on the scan line $S_{n+6}$. In this detection method, the sub-pixel sp-1, the sub-pixel sp-3, and the sub-pixel sp-6 are the detection sub-pixels; and the sub-pixel sp-2, the sub-pixel sp-4, and the sub-pixel sp-5 are the non-detection sub-pixels. One non-detection sub-pixel is arranged between the detection sub-pixel sp-1 and the detection sub-pixel sp-3, and two non-detection sub-pixels are arranged between the detection sub-pixel sp-3 and the detection sub-pixel sp-6. By comparing the brightness of the sub-pixel sp-1, the sub-pixel sp-3, and the sub-pixel sp-6 with the reference brightness, it is determined whether the signal line 20 has the micro-crack. In the detection method provided by this embodiment, the detection sub-pixels in the pixel column (a part of the sub-pixels in the pixel column) are controlled to emit light according to multiple data signals, so as to determine whether the signal line has the micro-crack.

Figure 17:
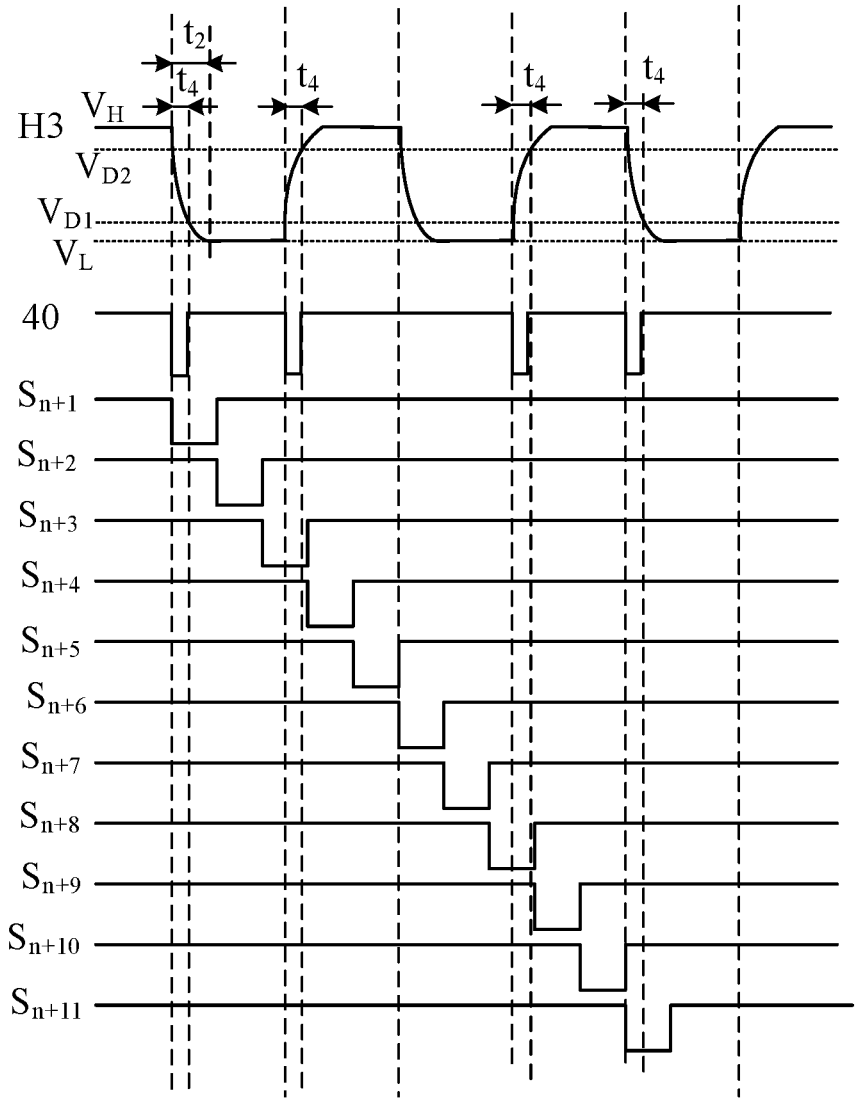
FIG. 17 illustrates another time sequence diagram in the detection method provided by an embodiment of the present disclosure.

In another embodiment, the step S502 includes: controlling the switch unit to be turned on once in each of two falling periods, where in the falling period, the signal on the signal line hops from the high-level signal to the low-level signal; and controlling the switch unit to be turned on once in each of two rising periods between the two falling periods, where in the rising period, the signal on the signal line hops from the low-level signal to the high-level signal. FIG. 17 illustrates another time sequence diagram of a detection method provided by an embodiment of the present disclosure. In an example, as shown in FIG. 17, the signal transmitted on the signal line 20 is H3 shown in FIG. 3. The switch control line 40 provides the active level signal to control the switch unit 30 to be turned on once in each of two falling period, where in the falling period, the signal on the signal line 20 hops from the high-level signal to the low-level signal. In addition, the switch control line 40 provides the active level signal to control the switch unit 30 to be turned on once at a time between the two falling periods, i.e., in each of two rising periods, where in the rising period, the signal on the signal line 20 hops from the low-level signal to the high-level signal. The on-time of the switch unit 30 is $t_4$, where $t_4$ is shorter than $t_2$. Herein, when the switch unit 30 is controlled to be turned on once in the period of the signal hopping from the high-level signal to the low-level signal, the data signal written into the data line 10 is the first data signal $V_{D1}$. When the switch unit 30 is controlled to be turned on once in the period of the signal hopping from the low-level signal to the high-level signal, the data signal written into the data line 10 is the second data signal $V_{D2}$.

FIG. 17 also illustrates a time sequence of the scan signal transmission of scan lines $S_{n+1}$ to $S_{n+11}$. It can be understood from the description of the above related embodiments that when the switch control line 40 provides the active level signal at the first time, the first data signal is written into the data line 10, and a scan signal is provided to the scan line $S_{n+1}$ to control the first data signal to be written into the sub-pixel connected to the scan line $S_{n+1}$. When the scan signal is provided to the scan line $S_{n+3}$, the truncated second data signal is written into the sub-pixel connected to the scan line $S_{n+3}$. When the scan signal is provided to the scan line $S_{n+8}$, the truncated second data signal is written into the sub-pixel connected to the scan line $S_{n+8}$. When the scan signal is provided to the scan line $S_{n+11}$, the truncated first data signal is written into the sub-pixel connected to the scan line $S_{n+11}$. Herein, in one pixel column, the sub-pixel connected to the scan line $S_{n+1}$, the sub-pixel connected to the scan line $S_{n+3}$, the sub-pixel connected to the scan line $S_{n+8}$, and the sub-pixel connected to the scan line $S_{n+11}$ are the detection sub-pixels, and any other sub-pixel is the non-detection sub-pixel. In the detection method provided by this embodiment, the manner of writing the data signals into the data line 10 includes: writing at least two second data signals between two first data signals. According to multiple data signals, the detection sub-pixels in the pixel column (some of the sub-pixels arranged in the pixel column) are controlled to emit light, so as to determine whether the signal line has the micro-crack. Moreover, the detection sub-pixels include first sub-pixels and second sub-pixel. The sub-pixels, to which the first data signal is written and the scan line $S_{n+1}$ and the scan line $S_{n+11}$ are connected, are the first sub-pixels. The sub-pixels, to which the second data signal is written and the scan line $S_{n+3}$ and the scan line $S_{n+8}$ are connected, are the second sub-pixels. If the light-emitting brightness of the first sub-pixel is less than the first reference brightness, and the light-emitting brightness of the second sub-pixel is greater than the second reference brightness, it is determined that the signal line has the micro-crack.

In another embodiment, the step S502 includes: controlling the switch unit to be turned on once in each of two rising periods, where in the rising period, the signal on the signal line hops from the low-level signal to the high-level signal; and controlling the switch unit to be turned on once in each of two falling periods between the two rising periods, where in the falling period, the signal on the signal line hops from the high-level signal to the low-level signal. In this embodiment, the manner for writing the data signals into the data line includes: writing at least two first data signals between two second data signals.

Figure 18:
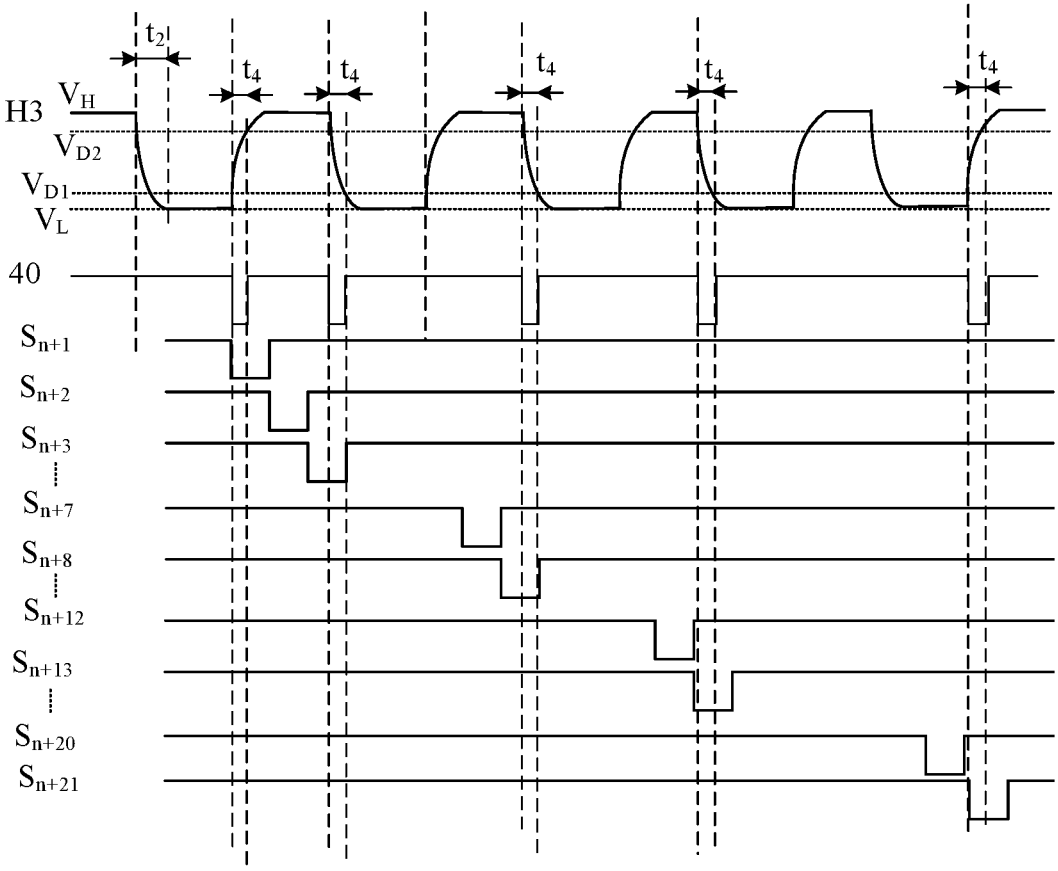
FIG. 18 illustrates another time sequence diagram in the detection method provided by an embodiment of the present disclosure.

FIG. 18 illustrates another time sequence diagram in a detection method provided by an embodiment of the present disclosure. In an example, as shown in FIG. 18, the signal transmitted on the signal line 20 is H3 shown in FIG. 3. The switch control line 40 provides the active level signal to control the switch unit 30 to be turned on once in each of two rising periods, where in the rising period, the signal on the signal line 20 hops from the low-level signal to the high-level signal; and the switch control line 40 provides the active level signal to control the switch unit to be turned on once at the time between the two rising period, i.e., in each of three falling periods between the two rising periods, where in the falling period, the signal on the signal line 20 hops from the high-level signal to the low-level signal. The on-time of the switch unit 30 is $t_4$, where $t_4$ is shorter than $t_2$. FIG. 18 illustrates a time sequence of the scan signal transmission of some scan lines among the scan lines $S_{n+1}$ to $S_{n+21}$. According to the above description in FIG. 17, it can be understood that in the embodiment of FIG. 18, when the scan signal is provided to the scan line $S_{n+1}$, the truncated second data signal is written into the sub-pixel connected to the scan line $S_{n+1}$. When the scan signal is provided to the scan line $S_{n+3}$, the truncated first data signal is written into the sub-pixel connected to the scan line $S_{n+3}$. When the scan signal is provided to the scan line $S_{n+8}$, the truncated first data signal is written into the sub-pixel connected to the scan line $S_{n+8}$. When the scan signal is provided to the scan line $S_{n+13}$, the truncated first data signal is written into the sub-pixel connected to the scan line $S_{n+13}$. When the scan signal is provided to the scan line $S_{n+21}$, the truncated second data signal is written into the sub-pixel connected to the scan line $S_{n+21}$. Then, in one pixel column, the sub-pixels connected to the scan line $S_{n+1}$, the scan line $S_{n+3}$, the scan line $S_{n+8}$, the scan line $S_{n+13}$, and the scan line $S_{n+21}$ are the detection sub-pixels; and any other sub-pixel is the non-detection sub-pixel. In the detection method provided by this embodiment, the manner for writing the data signal into the data line 10 includes: writing three first data signals between two second data signals. The detection sub-pixels in the pixel column (some of the sub-pixels in the pixel column) are controlled to emit light according to multiple data signals, so as to determine whether the signal line has the micro-crack. Moreover, the detection sub-pixels include first sub-pixels and second sub-pixels. The sub-pixels, to which the first data signal is written and the scan line $S_{n+3}$, the scan line $S_{n+8}$, and the scan line $S_{n+13}$ are connected, are the first sub-pixels. The sub-pixels, to which the second data signal is written and the scan line $S_{n+1}$ and the scan line $S_{n+21}$ are connected, are the second sub-pixels. If the light-emitting brightness of the first sub-pixel is less than the first reference brightness, and the light-emitting brightness of the second sub-pixel is greater than the second reference brightness, it is determined that the signal line has the micro-crack.

Figure 19:
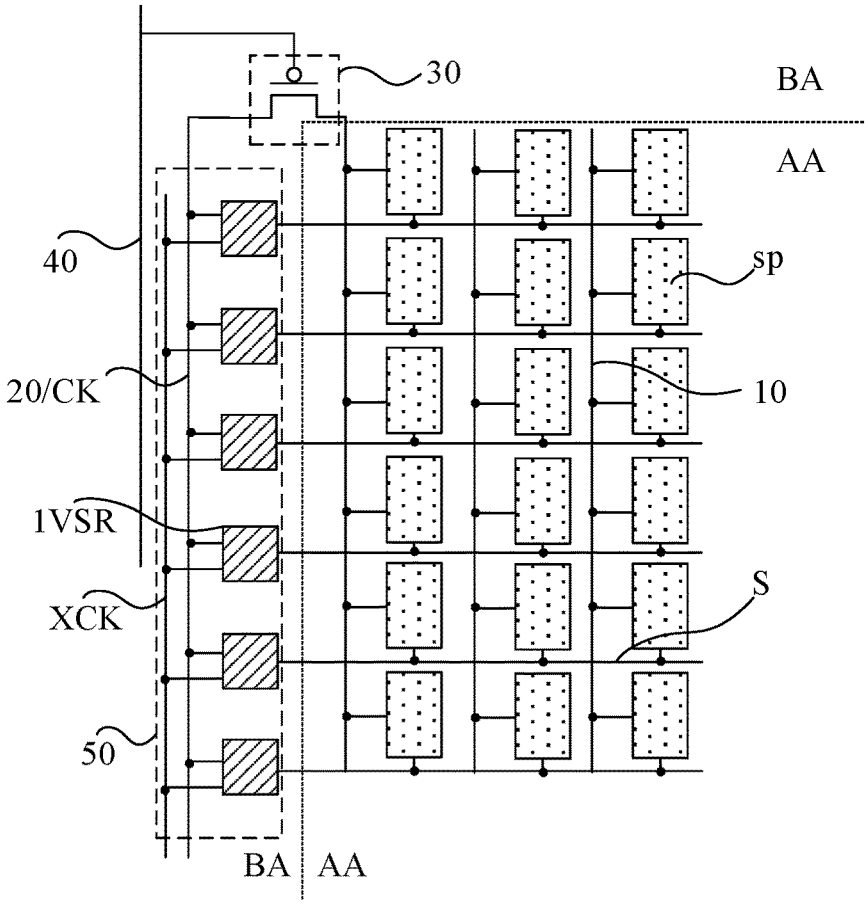
FIG. 19 is a schematic diagram of a display panel according to another embodiment of the present disclosure.
Figure 20:
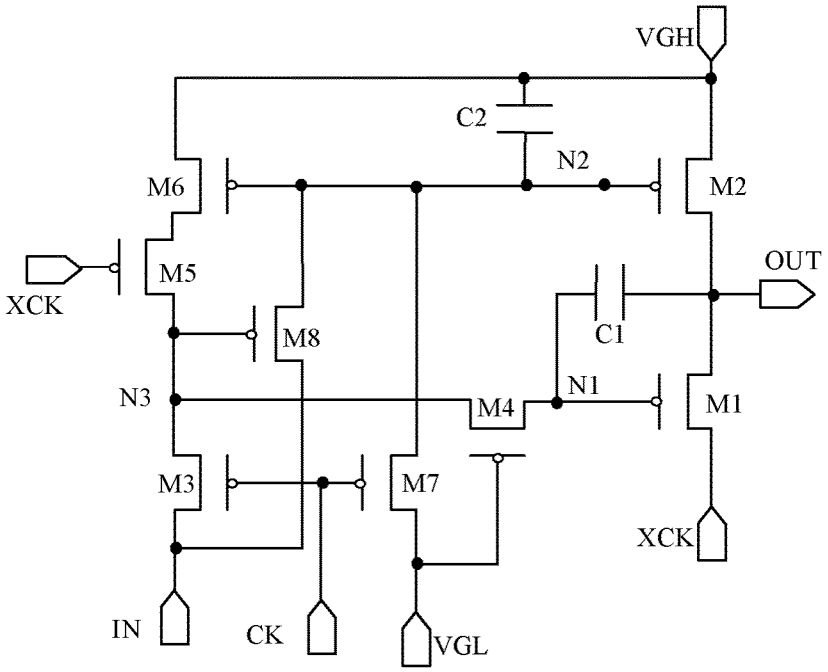
FIG. 20 is a schematic structural diagram of a shift unit in a display panel provided by an embodiment of the present disclosure.

In an example, the detection method provided by this embodiment of the present disclosure can be used to detect a clock signal for driving a shift unit to operate. FIG. 19 is a schematic diagram of a display panel according to another embodiment of the present disclosure. FIG. 20 is a schematic structural diagram of a shift unit in a display panel provided by an embodiment of the present disclosure. As shown in FIG. 19, the display panel further includes multiple scan lines S. One scan line S is electrically connected to multiple sub-pixels sp arranged in one pixel row. The non-display area BA further includes a first driving circuit 50. The first driving circuit 50 includes multiple first shift units 1VSR that are cascaded, and an output terminal of each of multiple first shift units 1VSR is connected to the scan line S. The first driving circuit includes a signal line 20. The signal line 20 includes a clock signal line configured to drive each of multiple first shift units 1VSR to output the scan signal.

FIG. 20 shows a structure of a shift unit. The shift unit includes eight transistors M1 to M8, and two capacitors (C1 and C2), and further shows clock signal terminals XCK\CK, an input terminal IN, an output terminal OUT, a high-level signal terminal VGH, and a low-level signal terminal VGL. The first shift unit 1VSR may adopt the structure of the shift unit shown in FIG. 20. In multiple cascaded first shift units, the input terminal IN of a first stage of first shift unit is connected to an initial signal terminal, and the input terminal IN of the other stage of first shift unit is connected to the output terminal OUT of the previous stage of first shift unit. The first driving circuit 50 includes two clock signal lines, one clock signal line provides a clock signal to the clock signal terminal XCK, and the other clock signal line provides a clock signal to the clock signal terminal CK.

The step S103 of controlling the sub-pixel connected to the data line to emit light according to the data signal includes: providing a pulse signal to the first shift unit 1VSR through the signal line 20; providing a scan signal to the scan line S by the first shift unit 1VSR under control of the pulse signal; and writing the data signal into the sub-pixel sp under the control of the scan signal, so as to control the sub-pixel sp connected to the data line 10 to emit light. In this embodiment, while the signal on the signal line 20 drives the first driving circuit 50 to operate, the pulse signal on the signal line 20 can be truncated to serve as a data signal by controlling the switch unit 30, so as to control the sub-pixel sp to emit light through the data signal. In this way, whether the signal line 20 has the micro-crack is determined according to the brightness of the sub-pixel.

In this embodiment, a pulse width of the scan signal provided by the scan line is equal to a pulse width of the pulse signal on the signal line. For example, in an embodiment, in each period of the signal hopping from the high-level signal to the low-level signal, the switch control line 40 provides the active level signal to control the switch unit 30 to be turned on once, so as to write the data signal into the data line 10 once. With reference to the description of the embodiment of FIG. 9, it can be understood that the detection sub-pixels in the pixel column are controlled to emit light according to multiple data signals to determine whether the signal line has the micro-crack. In another embodiment, in each period of the signal hopping from the low-level signal to the high-level signal, the switch control line 40 provides the active level signal to control the switch unit 30 to be turned on once, so as to write the data signal into the data line 10 once. With reference to the description of the embodiment of FIG. 12, it can be understood that the detection sub-pixels in the pixel column are controlled to emit light according to multiple data signals to determine whether the signal line has the micro-crack. In another embodiment, in each period of the signal hopping from the low-level signal to the high-level signal and in each period of the signal hopping from the high-level signal to the low-level signal, the switch control line 40 provides the active level signal to control the switch unit 30 to be turned on once, so as to write the data signal into the data line 10. With reference to the description of the embodiment of FIG. 15, it can be understood that a corresponding data signal is written into multiple sub-pixels connected to one data line 10 to control the multiple sub-pixels to emit light, so as to determine whether the signal line has the micro-crack.

Figure 21:
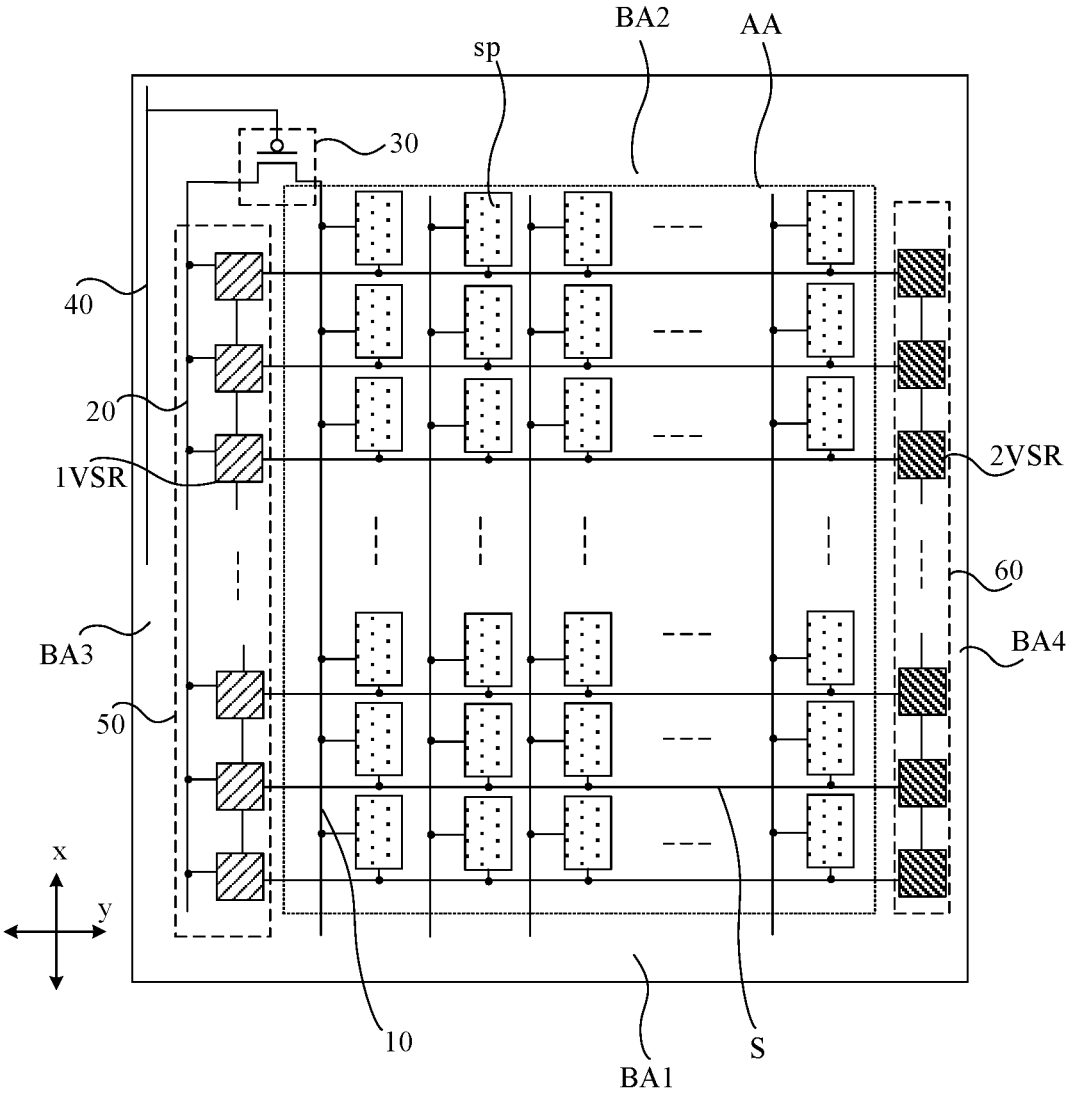
FIG. 21 is a schematic diagram of a display panel according to another embodiment of the present disclosure.

FIG. 21 is a schematic diagram of a display panel according to another embodiment of the present disclosure. In another embodiment, as shown in FIG. 21, the non-display area BA includes a first non-display area BA1 and a second non-display area BA2 that are located at two sides of the display area AA in a first direction x. The non-display area BA further includes a third non-display area BA3 and a fourth non-display area BA4 that are located at both sides of the display area AA in a second direction y. The first direction x intersects with the second direction y. The data line 10 extends along the first direction x. The display panel further includes multiple scan lines S. One scan line S is electrically connected to multiple sub-pixels sp in one pixel row. The non-display area BA further includes: a first driving circuit 50 located in the third non-display area BA3 and a second driving circuit 60 located in the fourth non-display area BA4. The first driving circuit 50 includes multiple first shift units 1VSR that are cascaded. The second driving circuit 60 includes multiple second shift units 2VSR that are cascaded. An end of the scan line S is connected to an output terminal of the first shift unit 1VSR, and another end of the scan line S is connected to an output terminal of the second shift unit 2VSR. Herein, the first driving circuit 50 includes a signal line 20. The signal line 20 extends along the first direction x in the third non-display area BA3. The signal line 20 includes any one or more of an initial signal line, a clock signal line, and a constant-level signal line.

The signal line 20 in the embodiment of FIG. 21 can be detected by using the detection method provided by any embodiments of FIG. 2 to FIG. 18. In the detection process, controlling the sub-pixel connected to the data line to emit light according to the data signal includes: providing the scan signal to the scan line S; and writing a data signal into the sub-pixel sp under the control of the scan signal, so as to control the sub-pixel sp connected to the data line 10 to emit light. For example, the second driving circuit 60 is driven to operate, so as to provide the scan signal to the scan line S through a second shift unit 2VSR.

In the detection process, a pulse signal is provided to the signal line 20. At this time, the first shift unit 1VSR is not driven to operate by the pulse signal on the signal line 20, that is, multiple cascaded first shift units 1VSR do not operate. The second driving circuit 60 is driven to operate, and a scan signal is provided to the scan line S under the control of the second shift unit 2VSR, so as to write into the corresponding sub-pixel sp the data signal, which is written into the data line 10 through the signal line 20. In this way, whether the signal line 20 has the micro-crack is determined by comparing the brightness of the sub-pixel with the reference brightness.

After the display panel provided by the embodiment of FIG. 21 is shipped from the factory, when the display panel is in normal display operation, the first driving circuit 50 and the second driving circuit 60 operate simultaneously to provide a scan signal to the scan line S.

Figure 22:
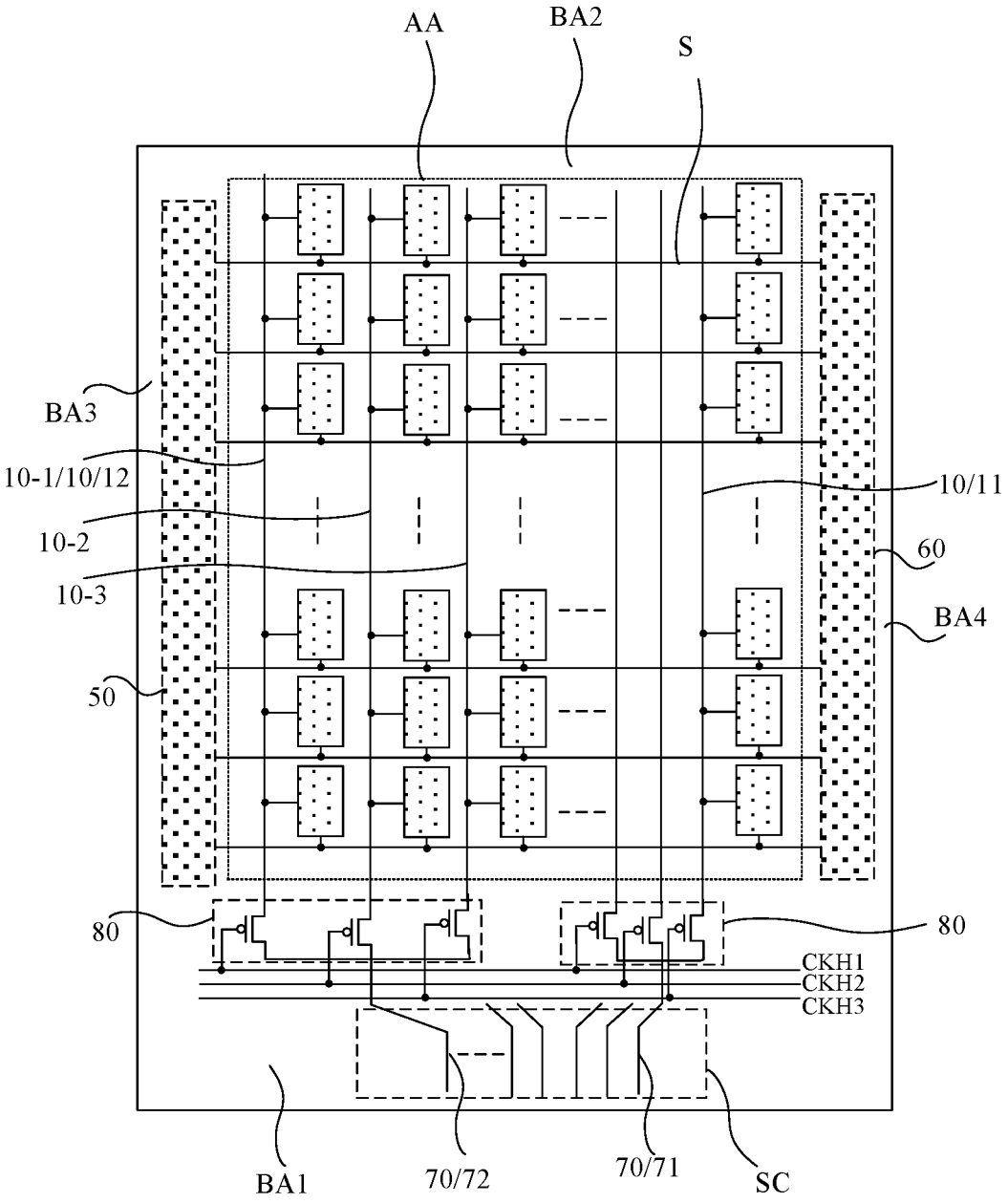
FIG. 22 is a schematic diagram of a display panel according to another embodiment of the present disclosure.
Figure 23:
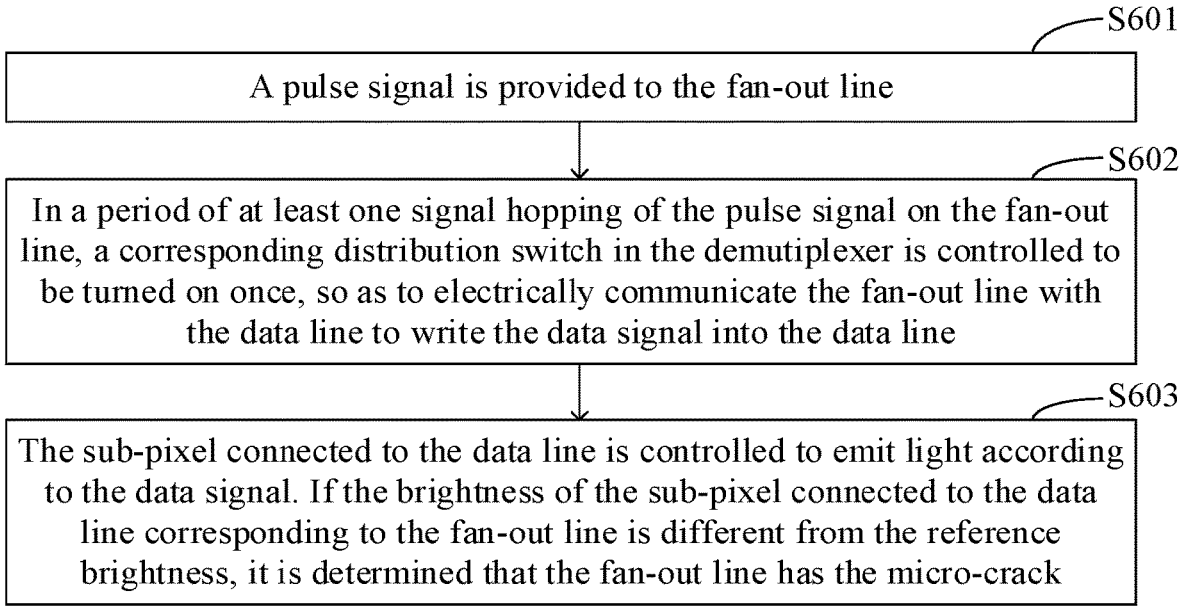
FIG. 23 is a flowchart of a detection method according to another embodiment of the present disclosure.
Figure 24:
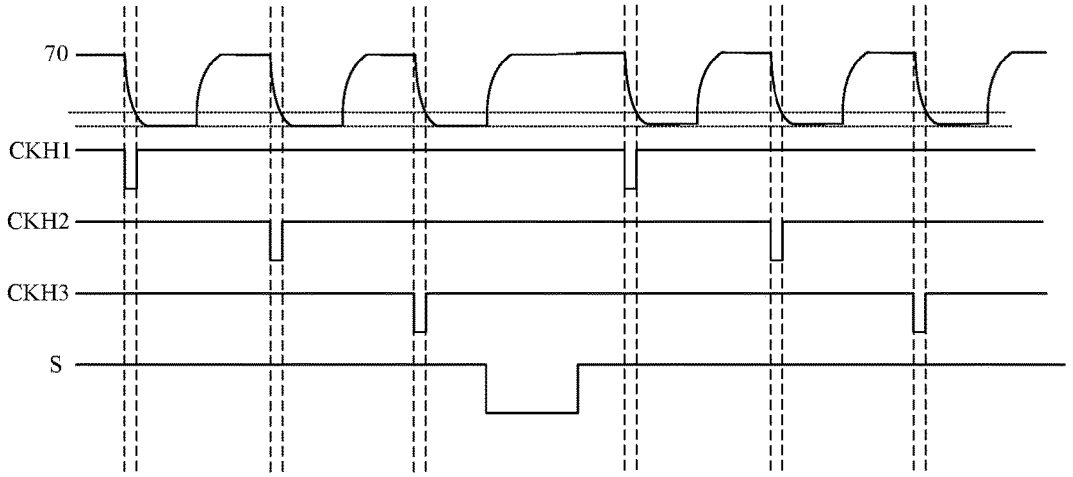
FIG. 24 illustrates a time sequence diagram of a detection method provided by the embodiment of FIG. 23.

Further, FIG. 22 is a schematic diagram of another display panel provided by an embodiment of the present disclosure, FIG. 23 is a flowchart of a detection method according to another embodiment of the present disclosure, and FIG. 24 illustrates a time sequence diagram of the detection method provided by the embodiment of FIG. 23. As shown in FIG. 22, the non-display area BA includes a first non-display area BA1, a second non-display area BA2, a third non-display area BA3, and a fourth non-display area BA4. The non-display area includes a fan-out area SC located in the first non-display area BA1. The fan-out area SC includes multiple fan-out lines 70. The non-display area further includes multiple demultiplexers 80. An end of the fan-out line 70 is connected to at least two data lines 10 through the demultiplexer 80. One demultiplexer 80 includes at least two distribution switches, and one distribution switch corresponds to a respective one data line 10. For example, as shown in FIG. 22, the demultiplexer 80 includes three distribution switches (not labeled in FIG. 22). The non-display area further includes distribution control lines. The control terminals of different distribution switches of one demultiplexer 80 are connected to different distribution control lines. FIG. 22 illustrates three distribution control lines CKH1, CKH2, and CKH3. FIG. 22 further illustrates a first driving circuit 50 and a second driving circuit 60 that are located in the non-display area, and multiple scan lines. Herein, the signal line includes the fan-out line 70, the demultiplexer 80 is reused as a switch unit, and the distribution control line is reused as the switch control line.

The fan-out line in the embodiment of FIG. 22 can be detected by using the detection method provided by the embodiment of FIG. 23. As shown in FIG. 23, the detection method includes the following steps.

At step S601, a pulse signal is provided to the fan-out line 70.

At step S602, in a period of at least one signal hopping of the pulse signal on the fan-out line 70, a corresponding distribution switch in the demutliplexer 80 is controlled to be turned on once, so as to electrically connect the fan-out line 70 with the data line 10 to write the data signal into the data line 10.

The following embodiment may be understood with reference to the structure of the display panel illustrated in FIG. 22 and the time sequence diagram illustrated in FIG. 24. FIG. 24 illustrates a time sequence of the pulse signal transmitted on the fan-out line 70 when the fan-out line 70 has the micro-crack. It can be understood taking the work process of one demultiplexer 80 as an example. The demultiplexer 80 is connected to three data lines, which are a data line 10-1, a data line 10-2, and a data line 10-3.

The active level signal is provided to the distribution control line CKH1 first, so as to control the distribution switch connected to the distribution control line CKH1 to be turned on; the fan-out line 70 is electrically connected with the data line 10-1; and then the truncated date signal in the period of the signal hopping from the high-level signal to the low-level signal is written into the data line 10-1. The active level signal is provided to the distribution control line CKH2, so as to control the distribution switch connected to the distribution control line CKH2 to be turned on; the fan-out line 70 is electrically connected with the data line 10-2; and then the truncated data signal in the period of the signal hopping from the high-level signal to the low-level signal is written into the data line 10-2. The active level signal is provided to the distribution control line CKH3, so as control the distribution switch connected to the distribution control line CKH3 to be turned on; the fan-out line 70 is electrically connected with the data line 10-3; and then the truncated data signal in the period of the signal hopping from the high-level signal to the low-level signal is written into the data line 10-3. That is, after the active level signal is provided to each of the distribution control lines CKH1, CKH2, and CKH3 once, the data signal is written into each of the data lines 10-1, 10-2, and 10-3 once. After the data signal is written into each of the data line 10-1, the data line 10-2 and the data line 10-3, the scan line S then provides scan signals to control to write data signals to three sub-pixels sp through the data line 10-1, the data line 10-2 and the data line 10-3, where the three sub-pixels sp are connected to the scan line S and respectively connected to the data line 10-1, the data line 10-2 and the data line 10-3. The sub-pixels, respectively connected to the data line 10-1, the data line 10-2 and the data line 10-3, are controlled to emit light via the corresponding data lines.

At step S603, the sub-pixel sp connected to the data line 10 is controlled to emit light according to the data signal; if the brightness of the sub-pixel sp connected to the data line 10 corresponding to the fan-out line 70 is different from the reference brightness, it is determined that the fan-out line 70 has the micro-crack.

In an example, as shown in FIG. 24, the data signal is truncated in the period of the signal hopping from the high-level signal to the low-level signal. In this example, when the fan-out line 70 has the micro-crack, the data signals written into the data line 10-1, the data line 10-2 and the data line 10-3 all have a level higher than the level of the low-level signal of the pulse signal. Thus, the brightness of each of the sub-pixels respectively connected to the data line 10-1, the data line 10-2, and the data line 10-3 is less than the reference brightness, and it is determined that the fan-out line has the micro-crack.

In an example, as shown in FIG. 24, the data signal is truncated in the period of the signal hopping from the high-level signal to the low-level signal.

In another embodiment, with reference to the embodiment of FIG. 10, it can be understood that when the fan-out line is detected, in the period of the signal hopping on the fan-out line from the low-level signal to the high-level signal, the active level signal is provided the distribution control line to control the distribution switch, which is connected to the distribution control line, to be turned on. In this way, the data signal is written to the corresponding data line. In this embodiment, if the brightness of the sub-pixel connected to the data line is greater than the reference brightness, it is determined that the fan-out line has the micro-crack.

In another embodiment, with reference to the embodiment of FIG. 13, it can be understood that when the fan-out line is detected, in the period of the signal hopping on the fan-out line from the low-level signal to the high-level signal, the active level signal is provided to a part of distribution control lines to control the distribution switch connected to them to be turned on once, so as to write the data signals to the corresponding data lines; and in the period of the signal hopping on the fan-out line from the high-level signal to the low-level signal, the active level signal is provided to a part of distribution control lines to control the distribution switch connected to them to be turned on once, so as to write the data signals to the corresponding data lines. If the brightness of the sub-pixel controlled by the data signal truncated in the period of the signal hopping from the high-level signal to the low-level signal is less than the first reference brightness, and the brightness of the sub-pixel controlled by the data signal truncated in the period of the signal hopping from the low-level signal to the high-level signal is greater than the second reference brightness, it is determined that the fan-out line has the micro-crack.

For example, in an embodiment, the sub-pixel connected to the data line 10-1 is a first color sub-pixel, and the sub-pixel connected to the data line 10-2 is a second color sub-pixel, and the sub-pixel connected to the data line 10-3 is a third color sub-pixel. When the fan-out line 70 in the display panel is detected, one of three distribution control lines can be controlled to provide the active level signal in the period of the signal hopping on the fan-out line 70, so as to determine whether the fan-out line 70 has the micro-crack according to a brightness of the sub-pixel controlled by the one of the three data lines.

In another embodiment, when the fan-out line 70 in the display panel is detected, two of three distribution control lines can be controlled to respectively provide the active level signal in the period of the signal hopping on the fan-out line 70, so as to determine whether the fan-out line 70 has the micro-crack according to the brightness of the sub-pixels controlled by the two of the three data lines.

Further, the fan-out lines include a first fan-out line 71 and a second fan-out line 72. The first fan-out line 71 is connected to the first data line 11 through the demultiplexer 80, and the second fan-out line 72 is connected to the second data line 12 through the demultiplexer 80. The first fan-out line 11 is reused as a reference signal line. During the detection of the display panel, the following steps are performed.

At step S601, the same pule signal is provided to the first fan-out line 71 and the second fan-out line 72.

At step S602, a corresponding distribution switch in the demultiplexer 80 is controlled to be turned on once in the period of the signal hopping of the pulse signal on the first fan-out line 71, so as to electrically connect the first fan-out line 71 with the first data line 11 to write a data signal into the first data line 11. A corresponding distribution switch in the demultiplexer 80 is controlled to be turned on once in the period of the signal hopping of the pulse signal on the second fan-out line 72, so as to electrically connect the second fan-out line 71 with the second data line 12 to write the data signal into the second data line 12. Taking the moment when the distribution control line CKH1 provides the active level signal as an example, when the distribution control line CKH1 provides the active level signal, a distribution switch of the demultiplexer 80 connected to the first fan-out line 71 is turned on, and a distribution switch of the demultiplexer 80 connected to the second fan-out line 72 is synchronously turned on. In other words, the same data signal is written into the data line 10 connected to the first fan-out line 71 and the data line 10 connected to the second fan-out line 72. Thus, if one of the first fan-out line 71 and the second fan-out line 72 has the micro-crack and the other one thereof does not have the micro-crack, the brightness of the sub-pixel sp connected to the data line 10 corresponding to the first fan-out line 71 is different from the brightness of the sub-pixel sp connected to the data line 10 corresponding to the second fan-out line 72.

At step S603, the brightness of the sub-pixel sp in the pixel column connected to the first data line 11 corresponding to the first fan-out line 71 is the reference brightness; and if the brightness of the sub-pixel sp in the pixel column connected to the second data line 12 corresponding to the second fan-out line 72 is different from the brightness of the sub-pixel sp in the pixel column connected to the first data line 11 corresponding to the first fan-out line 71, it is determined that the second fan-out line 72 has the micro-crack.

In this embodiment, the same pulse signal is provided to multiple fan-out lines. If the fan-out line has the micro-crack, the fan-out line having no micro-crack among the multiple fan-out lines can be used as a reference signal line. In the detection process, the micro-crack on the fan-out line can be detected by intuitively comparing the brightness of the sub-pixels located in different areas of the display panel.

Figure 25:
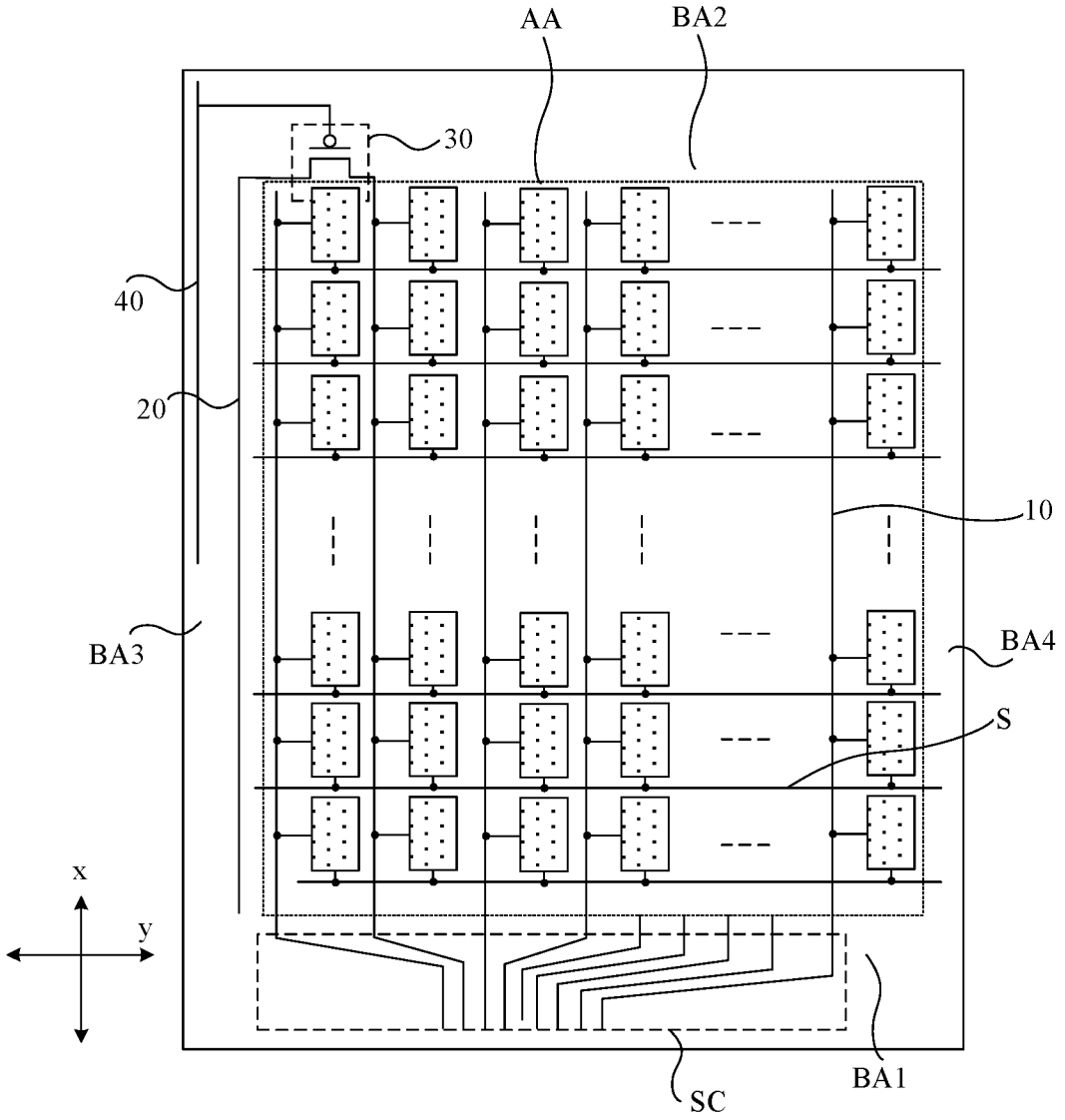
FIG. 25 is a schematic diagram of a display panel according to another embodiment of the present disclosure.

In an embodiment, FIG. 25 is a schematic diagram of a display panel according to another embodiment of the present disclosure. As shown in FIG. 25, the non-display area BA includes a first non-display area BA1 and a second non-display area BA2, which are located at two sides of the display area AA in a first direction x; and a third non-display area BA3 and a fourth non-display area BA4, which are located at two sides of the display area AA in a second direction y. The first direction x intersects with the second direction y. The data line 10 extends along the first direction x. The non-display area further includes a fan-out area SC located in the first non-display area BA1. The signal line 20 extends along the first direction x in the third non-display area BA3. For the display panel provided by this embodiment, the detection method provided by any of the embodiments of FIG. 2 to FIG. 18 can be used to detect whether the signal line 20 has the micro-crack, so as to detect the micro-crack on the signal lines located at left and right sides of the display panel.

With further reference to FIG. 25, the switch unit 30 is located in the second non-display area BA2. In practical applications, the second non-display area corresponds to a top border of the product, and the third and fourth non-display areas correspond to the left border and the right border of the product. The switch unit is arranged in the second non-display area, so that an occupied area of the left border and the right border of the panel can be reduced, thereby avoiding an increased width of the left border and the right border.

Figure 26:
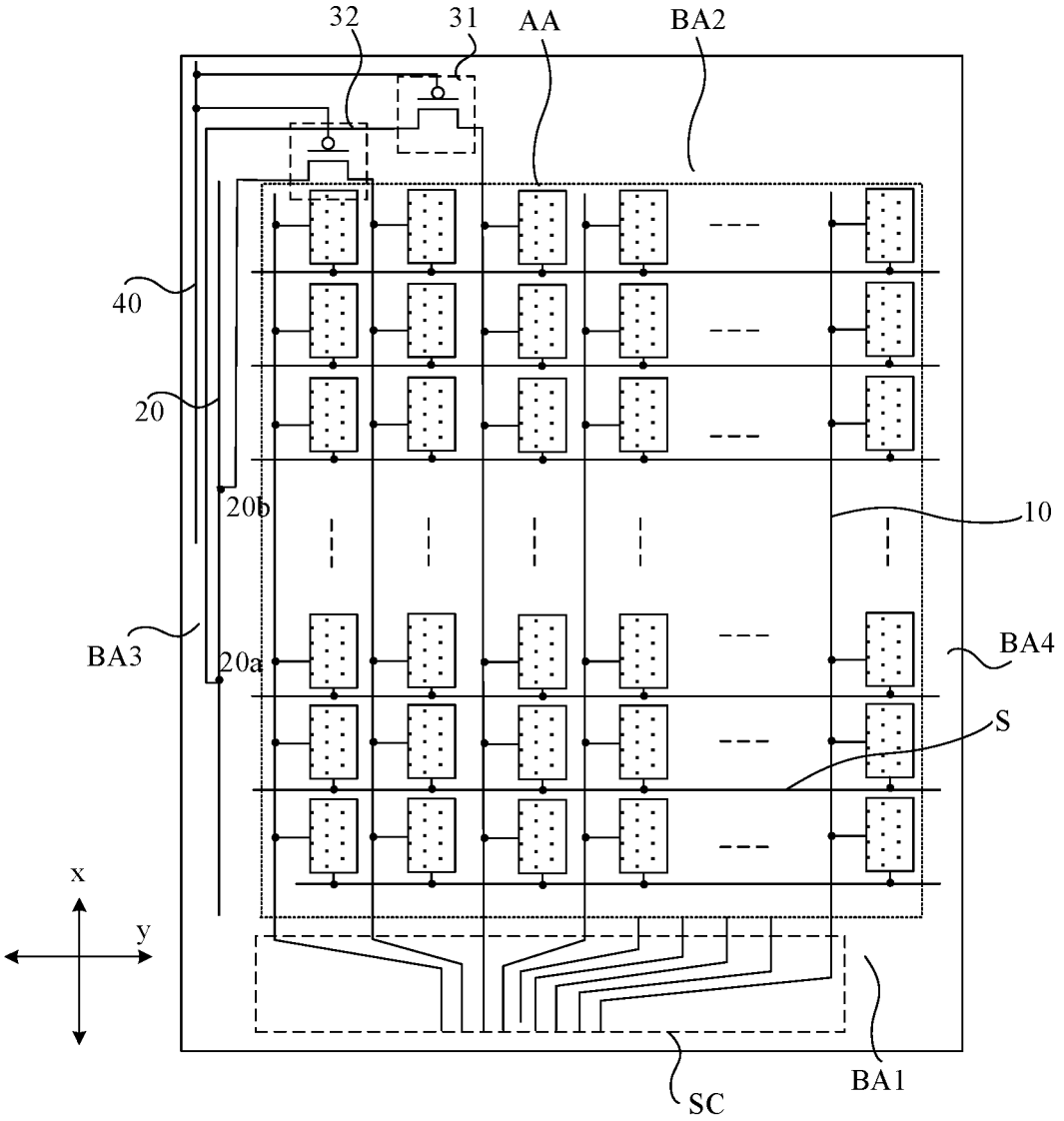
FIG. 26 is a schematic diagram of a display panel according to another embodiment of the present disclosure.

FIG. 26 is a schematic diagram of a display panel according to another embodiment of the present disclosure. In an embodiment, as shown in FIG. 26, the signal line 20 has a first position point 20*a* and a second position point 20*b*, and the second position point 20*b* is located at a side of the first position point 20*a* away from the first non-display area BA1. The switch unit 30 includes a first switch unit 31 and a second switch unit 32, an input terminal of the first switch unit 31 is connected to the first position point 20*a*, an input terminal of the second switch unit 32 is connected to the second position point 20*b*, and an output terminal of the first switch unit 31 and an output terminal of the second switch unit 32 are connected to different data lines 10. The signal line 20 extends in the third non-display area BA3, and extends into the first non-display area BA1 and then is connected to a driving chip (not shown in FIG. 26) of the display panel. When the display panel is in operation, the driving chip provides a signal to the signal line 20.

Herein, the signal line 20 can be detected by using the detection methods provided by the above-mentioned embodiments of the present disclosure. In the detection process, by comparing the brightness of the sub-pixel connected to the data line corresponding to the first position point 20*a* and the reference brightness, it can be determined whether a line segment, from the first position point 20*a* to a point connected to the driving chip, of the signal line 20 has the micro-crack. By comparing the brightness of the sub-pixel connected to the data line corresponding to the second position point 20*b* and the reference brightness, it can be determined whether a line segment, from the second position point 20*b* to a point connected to the driving chip, of the signal line 20 has the micro-crack. If the signal line has the micro-crack, a specific position of the micro-crack on the signal line can be detected.

Figure 27:
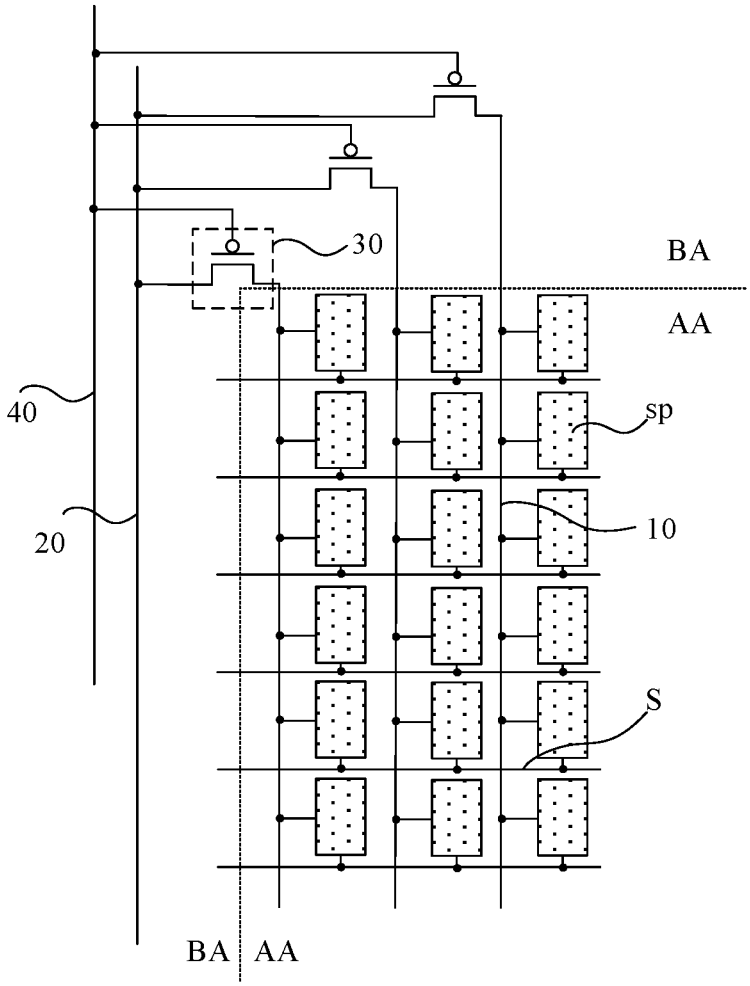
FIG. 27 is a partial schematic diagram of a display panel according to another embodiment of the present disclosure.

In an embodiment, the signal line is electrically connected to N data lines through multiple switch units, where N≥2, and N is an integer. One data line corresponds to one switch unit. In an example, FIG. 27 is a partial schematic diagram of a display panel according to another embodiment of the present disclosure. As shown in FIG. 27, taking N=3 as an example, the signal line is electrically connected to three data lines 10 through three switch units 30. For the display panel provided by this embodiment, the detection methods provided by the above-described embodiments can be used to detect the micro-crack on the signal line. One signal line corresponds to multiple data lines. In the detection process, by comparing brightness of multiple sub-pixels connected by multiple data lines with the reference brightness, it is determined whether the signal line has the micro-crack. The difference effect is more obvious when comparing a difference in the brightness, so as to achieve a high detection accuracy.

With further reference to FIG. 27, the control terminals of the switch units 30 connected to the same signal line 20 are connected to the same switch control line 40. That is, the switch states of multiple switch units 30 are controlled by one switch control line 40. Thus, the number of switch control lines 40 can be reduced, thereby saving an area of the non-display area.

Figure 28:
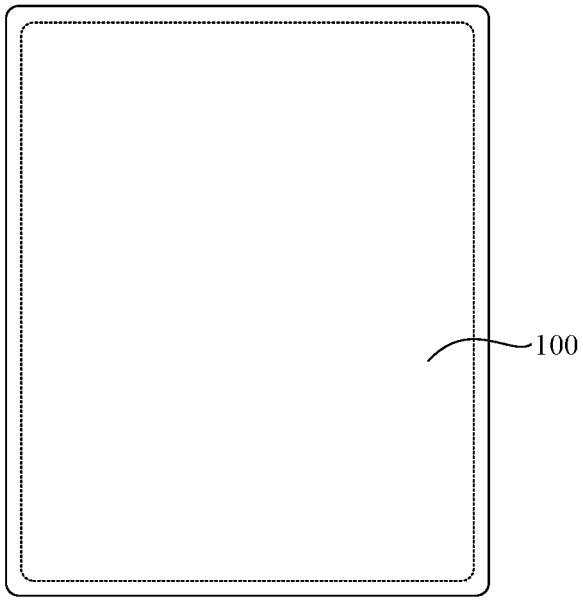
FIG. 28 is a schematic diagram of a display device according to an embodiment of the present disclosure.

A display device is further provided according to an embodiment of the present disclosure. FIG. 28 is a schematic diagram of a display device according to an embodiment of the present disclosure. As shown in FIG. 28, the display device includes a display panel 100 provided by any embodiment of the present disclosure. The display device provided by this embodiment of the present disclosure may be any device with a display function, such as a mobile phone, a tablet computer, a notebook computer, an electronic paper book, a television, and a smart wearable product.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

Finally, it should be noted that, the above-described embodiments are merely for illustrating the present disclosure but not intended to provide any limitation. Although the present disclosure has been described in detail with reference to the above-described embodiments, it should be understood by those skilled in the art that, it is still possible to modify the technical solutions described in the above embodiments or to equivalently replace some or all of the technical features therein, but these modifications or replacements do not cause the essence of corresponding technical solutions to depart from the scope of the present disclosure.

What is claimed is:

1. A detection method for a display panel, wherein the display panel has a display area and a non-display area, wherein the display panel comprises:

a plurality of data lines arranged in the display area, wherein one of the plurality of data lines is connected to at least one sub-pixel in one pixel column; and at least one signal line, at least one switch unit, and at least one switch control line that are arranged in the non-display area, wherein one signal line of the at least one signal line is electrically connected to at least one data line through one switch unit of the at least one switch unit, and the switch unit comprises a control terminal electrically connected to one of the at least one switch control line, an input terminal electrically connected to the signal line, and an output terminal electrically connected to the at least one data line; and wherein the detection method comprises:

providing a pulse signal to the signal line;

controlling the switch unit to be turned on once in a period of at least one signal hopping of the pulse signal on the signal line, to electrically connect the signal line with the at least one data line, and writing a data signal to the at least one data line through the signal line, wherein the data signal is the pulse signal truncated in the period of the at least one signal hopping of the pulse signal; and controlling, based on the data signal, at least one sub-pixel connected to the at least one data line to emit light; and determining that the signal line has a micro-crack when a brightness of the at least one sub-pixel connected to the at least one data line corresponding to the signal line is different from a reference brightness.

2. The detection method according to claim 1, wherein the controlling the switch unit to be turned on once in a period of at least one signal hopping of the pulse signal on the signal line comprises: controlling an on-time of the switch unit to be T';

the determining that the signal line has a micro-crack when a brightness of the at least one sub-pixel connected to the at least one data line corresponding to the signal line is different from a reference brightness comprises: during the on-time of T', determining that the signal line has the micro-crack when the brightness of the at least one sub-pixel connected to the at least one data line corresponding to the signal line is different from the reference brightness; and before controlling the on-time of the switch unit to be T', the detection method further comprises: controlling the on-time of the switch unit to be T", wherein T'<T", and wherein when the on-time is T", the brightness of the at least one sub-pixel connected to the at least one data line corresponding to the signal line is the same as the reference brightness.

3. The detection method according to claim 1, wherein the controlling the switch unit to be turned on once in the period of at least one signal hopping of the pulse signal on the signal line comprises:

controlling the switch unit to be turned on once in a falling period of at least one signal hopping on the signal line from a high-level signal to a low-level signal;

the data signal comprises a first data signal, wherein the first data signal is the pulse signal truncated in the falling period of the signal hopping from the high-level signal to the low-level signal; and the controlling, based on the data signal, at least one sub-pixel connected to the at least one data line to emit light; and determining that the signal line has a micro-crack when a brightness of the at least one sub-pixel connected to the at least one data line corresponding to the signal line is different from a reference brightness, comprises:

controlling, based on the first data signal, the at least one sub-pixel connected to the at least one data line to emit light, the signal line being determined to have the micro-crack when the brightness of the at least one sub-pixel is less than the reference brightness, wherein the reference brightness is a light-emitting brightness of a sub-pixel when the low-level signal of the pulse signal is written to the sub-pixel.

4. The detection method according to claim 1, wherein the controlling the switch unit to be turned on once in the period of at least one signal hopping of the pulse signal on the signal line comprises:

controlling the switch unit to be turned on once in a rising period of at least one signal hopping on the signal line from a low-level signal to a high-level signal;

the data signal comprises a second data signal, wherein the second data signal is the pulse signal truncated in the rising period of the signal hopping from the low-level signal to the high-level signal; and the controlling, based on the data signal, at least one sub-pixel connected to the at least one data line to emit light; and determining that the signal line has a micro-crack when a brightness of the at least one sub-pixel connected to the at least one data line corresponding to the signal line is different from a reference brightness comprises:

controlling, based on the second data signal, the at least one sub-pixel connected to the at least one data line to emit the light, the signal line being determined to have the micro-crack when a brightness of the at least one sub-pixel is greater than the reference brightness, wherein the reference brightness is a light-emitting brightness of a sub-pixel when the high-level signal of the pulse signal is written to the sub-pixel.

5. The detection method according to claim 1, wherein the controlling the switch unit to be turned on once in the period of at least one signal hopping of the pulse signal on the signal line comprises:

controlling the switch unit to be turned on once in a falling period of at least one signal hopping on the signal line from a high-level signal to a low-level signal, and controlling the switch unit to be turned on once in a rising period of at least one signal hopping on the signal line from the low-level signal to the high-level signal;

the data signal comprises a first data signal and a second data signal, the first data signal is the pulse signal truncated in the falling period, and the second data signal is the pulse signal truncated in the rising period;

the reference brightness comprises a first reference brightness and a second reference brightness;

the controlling, based on the data signal, at least one sub-pixel connected to the at least one data line to emit light comprises:

controlling, based on the first data signal, a first sub-pixel to emit light; and controlling, based on the second data signal, a second sub-pixel to emit light; and the determining that the signal line has a micro-crack when a brightness of the at least one sub-pixel connected to the at least one data line corresponding to the signal line is different from a reference brightness comprises:

determining that the signal line has the micro-crack when a brightness of the first sub-pixel is less than the first reference brightness and a brightness of the second sub-pixel is greater than the second reference brightness, wherein the first reference brightness is a light-emitting brightness of a sub-pixel when the low-level signal of the pulse signal is written to the sub-pixel, and the second reference brightness is a light-emitting brightness of the sub-pixel when the high-level signal of the pulse signal is written to the sub-pixel.

6. The detection method according to claim 5, wherein the controlling the switch unit to be turned on once in a falling period of at least one signal hopping on the signal line from a high-level signal to a low-level signal, and controlling the switch unit to be turned on once in a rising period of at least one signal hopping on the signal line from the low-level signal to the high-level signal comprises:

controlling the switch unit to be alternately turned on once in the falling period and once in the rising period.

7. The detection method according to claim 5, wherein the controlling the switch unit to be turned on once in a falling period of at least one signal hopping on the signal line from a high-level signal to a low-level signal, and controlling the switch unit to be turned on once in a rising period of at least one signal hopping on the signal line from a low-level signal to a high-level signal comprises:

controlling the switch unit to be turned on once in each of two falling periods, and controlling the switch unit to be turned on once in each of two rising periods between the two falling periods.

8. The detection method according to claim 5, wherein the controlling the switch unit to be turned on once in a falling period of at least one signal hopping on the signal line from a high-level signal to a low-level signal, and controlling the switch unit to be turned on once in a rising period of at least one signal hopping on the signal line from the low-level signal to the high-level signal comprises:

controlling the switch unit to be turned on once in each of two rising periods, and controlling the switch unit to be turned on once in each of two falling periods between the two rising periods.

9. The detection method according to claim 1, wherein the at least one sub-pixel in the pixel column comprises a plurality of sub-pixels, and one of the plurality of data lines is connected to the plurality of sub-pixels; and the controlling, based on the data signal, at least one sub-pixel connected to the at least one data line to emit light comprises: sequentially controlling, based on a plurality of data signals, the plurality of sub-pixels in the pixel column to emit light.

10. The detection method according to claim 1, wherein the at least one sub-pixel in the pixel column comprises a plurality of sub-pixels, and one of the plurality of data lines is connected to the plurality of sub-pixels, and the plurality of sub-pixels comprise a detection sub-pixel and a non-detection sub-pixel, and at least one non-detection sub-pixel is arranged between two adjacent detection sub-pixels; and the controlling, based on the data signal, at least one sub-pixel connected to the at least one data line to emit light comprises: controlling the detection sub-pixel in the pixel column to emit light based on a plurality of data signals.

11. The detection method according to claim 1, wherein the display panel further comprises a plurality of scan lines, wherein one of the plurality of scan lines is electrically connected to a plurality of sub-pixels in one pixel row;

the non-display area further comprises a first driving circuit, wherein the first driving circuit comprises a plurality of first shift units that are cascaded, and an output terminal of each of the plurality of first shift units is connected to one of the plurality of scan lines;

the first driving circuit comprises the signal line, the signal line comprises a clock signal line configured to drive the plurality of first shift units that are cascaded to output scan signals; and the controlling, based on the data signal, at least one sub-pixel connected to the at least one data line to emit light comprises:

providing the pulse signal to one of the plurality of first shift units through the signal line;

providing, by the one of the plurality of first shift units, one of the scan signals to the scan line under a control of the pulse signal; and writing the data signal to the at least one sub-pixel connected to the at least one data line under a control of the scan signal, to control the at least one sub-pixel connected to the at least one data line to emit light.

12. The detection method according to claim 1, wherein the non-display area further comprises a fan-out area;

wherein the display panel further comprises:

a plurality of fan-out lines arranged in the fan-out area;

a plurality of demultiplexers arranged in the non-display area, an end of each of the plurality of fan-out lines is connected to at least two data lines of the plurality of data lines through the demultiplexer; each of the plurality of demultiplexers comprises at least two distribution switches, and each of the at least two distribution switches corresponds to one of the at least two data lines; and distribution control lines arranged in the non-display area, wherein the at least two distribution switches in one of the plurality of demultiplexers have control terminals respectively connected to different ones of the distribution control lines, the at least one signal line comprises the plurality of fan-out lines, the demultiplexer is reused as the switch unit, and the distribution control line is reused as the switch control line;

wherein the providing the pulse signal to the signal line comprises: providing the pulse signal to the plurality of fan-out lines; and wherein the controlling the switch unit to be turned on once in a period of at least one signal hopping of the pulse signal on the signal line, to electrically connect the signal line with the at least one data line, and writing the data signal to the at least one data line through the signal line comprises:

in a period of at least one signal hopping of the pulse signal on the fan-out line, controlling a corresponding one of the at least two distribution switches in one of the plurality of demultiplexers to be turned on once, to electrically connect the fan-out line with the at least one data line, and writing the data signal to the at least one data line.

13. The detection method according to claim 12, wherein the plurality of fan-out lines comprises a first fan-out line and a second fan-out line; the first fan-out line is connected to a first data line through one of the plurality of demultiplexers, and the second fan-out line is connected to a second data line through the one of the plurality of demultiplexers; and the first fan-out line is reused as a reference signal line;

the determining that the signal line has the micro-crack when a brightness of the at least one sub-pixel connected to the at least one data line corresponding to the signal line is different from a reference brightness comprises:

determining that the second fan-out line has the micro-crack when a brightness of at least one sub-pixel in the pixel column connected to the second data line corresponding to the second fan-out line is different from a brightness of at least one sub-pixel in the pixel column connected to the first data line corresponding to the first fan-out line, wherein the brightness of the at least one sub-pixel in the pixel column connected to the first data line corresponding to the first fan-out line is the reference brightness.

14. The detection method according to claim 1, wherein the at least one sub-pixel in the pixel column comprises a plurality of sub-pixels;

wherein the display panel further comprises:

a plurality of scan lines, and one scan line of the plurality of scan lines is electrically connected to the plurality of sub-pixels in one pixel row; and a first driving circuit and a second driving circuit that are arranged in the non-display area, wherein the first driving circuit comprises a plurality of first shift units that are cascaded, the second driving circuit comprises a plurality of second shift units that are cascaded, and each of the plurality of scan lines comprises an end connected to an output terminal of one of the plurality of first shift units, and another end connected to an output terminal of one of the plurality of second shift units;

wherein the first driving circuit comprises the signal line, and the signal line comprises at least one of an initial signal line, a clock signal line, or a constant-level signal line; and wherein the controlling, based on the data signal, at least one sub-pixel connected to the at least one data line to emit light comprises: driving the second driving circuit to operate, to provide a scan signal to one of the plurality of scan lines through one of the plurality of second shift units.

15. A display panel, wherein the display panel has a display area and a non-display area, and wherein the display panel comprises:

a plurality of data lines arranged in the display area, wherein one of the plurality of data lines is electrically connected to at least one sub-pixel in one pixel column;

at least one signal line, at least one switch unit, and at least one switch control line that are arranged in the non-display area, wherein one signal line of the at least one signal line is electrically connected to at least one data line through one switch unit of the at least one switch unit, and the switch unit comprises a control terminal electrically connected to one of the at least one switch control line, an input terminal electrically connected to the signal line, and an output terminal electrically connected to the at least one data line; and the detection method according to claim 1 is adopted by the display panel to detect whether the signal line has a micro-crack.

16. The display panel of claim 15, wherein the non-display area comprises a first non-display area and a second non-display area that are located at two sides of the display area in a first direction, and a third non-display area and a fourth non-display area that are located at two sides of the display area in a second direction; wherein the first direction intersects with the second direction, and each of the plurality of data lines extends along the first direction;

the non-display area further comprises a fan-out area located in the first non-display area; and each of the at least one signal line extends along the first direction in the third non-display area.

17. The display panel according to claim 16, wherein the at least one switch unit is located in the second non-display area.

18. The display panel according to claim 16, wherein the signal line comprises a first position point and a second position point, and the second position point is located at a side of the first position point away from the first non-display area; and each of the at least one switch unit comprises a first switch unit and a second switch unit, an input terminal of the first switch unit is connected to the first position point, an input terminal of the second switch unit is connected to the second position point, and an output terminal of the first switch unit and an output terminal of the second switch unit are connected to different data lines of the plurality of data lines.

19. The display panel according to claim 16, further comprising:

a plurality of scan lines arranged in the display area, wherein the at least one sub-pixel in the pixel row comprises a plurality of sub-pixels, and one of the plurality of scan lines is electrically connected to the plurality of sub-pixels;

a first driving circuit located in the third non-display area; and a second driving circuit located in the fourth non-display area, wherein the first driving circuit comprises the at least one signal line, the first driving circuit further comprises a plurality of first shift units that are cascaded, the second driving circuit comprises a plurality of second shift units that are cascaded, one of the plurality of scan lines comprises an end connected to an output terminal of one of the plurality of first shift units, and another end connected to an output terminal of one of the plurality of second shift units; and wherein the signal line comprises at least one of an initial signal line, a clock signal line, or a constant-level signal line.

20. The display panel according to claim 16, wherein one of the at least one signal line is electrically connected to N data lines through a plurality of switch units, where N>2, and N is an integer; and one of the plurality of data lines corresponds to one of the plurality of switch units.

21. The display panel according to claim 20, wherein the control terminals of the plurality of switch units connected to one of the at least one signal line are connected to one of the at least one switch control line.

22. A display device, comprising a display panel, wherein the display panel has a display area and a non-display area, and wherein the display panel comprises:

a plurality of data lines arranged in the display area, wherein one of the plurality of data lines is electrically connected to at least one sub-pixel in one pixel column;

at least one signal line, at least one switch unit, and at least one switch control line that are arranged in the non-display area, wherein one signal line of the at least one signal line is electrically connected to at least one data line through one switch unit of the at least one switch unit, and the switch unit comprises a control terminal electrically connected to one of the at least one switch control line, an input terminal electrically connected to the signal line, and an output terminal electrically connected to the at least one data line; and the detection method according to claim 1 is adopted by the display panel to detect whether the signal line has a micro-crack.

* * * * *